US007357472B2

(12) United States Patent
Yamanobe

(10) Patent No.: US 7,357,472 B2
(45) Date of Patent: Apr. 15, 2008

(54) INKJET RECORDING APPARATUS AND METHOD

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 82 days.

(21) Appl. No.: 11/370,833

(22) Filed: Mar. 9, 2006

(65) Prior Publication Data

US 2006/0203019 A1 Sep. 14, 2006

(30) Foreign Application Priority Data

Mar. 10, 2005 (JP) ..... 2005-067822

(51) Int. Cl.
*B41J 2/205* (2006.01)

(52) U.S. Cl. ..... 347/15; 347/19

(58) Field of Classification Search ..... 347/15, 347/43, 19, 100, 96, 98
See application file for complete search history.

(56) References Cited

U.S. PATENT DOCUMENTS 6,471,323 B2 10/2002 Shibata et al.
2005/0185011 A1 8/2005 Kakutani

FOREIGN PATENT DOCUMENTS

JP 2002-67296 A 3/2002
JP 2005-14488 A 1/2005
JP 2005-40994 A 2/2005

*Primary Examiner*—Lamson Nguyen
(74) *Attorney, Agent, or Firm*—Birch, Stewart, Kolasch & Birch, LLP

(57) ABSTRACT

The inkjet recording apparatus comprises: an ink ejection head in which a plurality of ink ejection ports ejecting ink are arranged; a treatment liquid ejection head in which a plurality of treatment liquid ejection ports ejecting treatment liquid are arranged; a banding information acquisition device which acquires information identifying a location where banding occurs in a dot arrangement recorded onto a recording medium by the ink ejected from the ink ejection head; an ink droplet ejection control device which controls a volume of the ink ejected by the ink ejection head according to image data; and a treatment liquid droplet ejection control device which controls droplet ejection of the treatment liquid from the treatment liquid ejection head by controlling a volume of the treatment liquid ejected from the treatment liquid ejection ports corresponding to the location where the banding occurs, as identified by the banding information acquisition device, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs.

7 Claims, 15 Drawing Sheets

INKJET RECORDING APPARATUS AND METHOD

BACKGROUND OF THE INVENTION

1. Field of the Invention

The present invention relates to an inkjet recording apparatus and method, and more particularly, to technology for reducing the visibility of density non-uniformities (banding) in an inkjet recording apparatus which forms image on a recording medium using treatment liquid and ink.

2. Description of the Related Art

A method is known which improves optical density by preventing bleeding of ink through increasing the viscosity of ink or fixing ink by depositing droplets of treatment liquid which reacts with the ink, or applying the treatment liquid, prior to ink droplets of ink, and by maintaining coloring material of the ink in the vicinity of the surface of the recording medium (see, Japanese Patent Application Publication No. 2002-67296). In this system, a treatment liquid is used and dot bleeding is suppressed by the action of the treatment liquid. Consequently, the surface area of one dot is smaller than in a case where no treatment liquid is used. In particular, when ink droplets are deposited onto a medium other than special inkjet paper, there is a marked reduction in the dot surface area. This may result in highly conspicuous banding, which is dependent on deviation in the dot landing positions and ejection volumes. This problem is especially pronounced in line heads, which cannot perform shingling.

The main causes of deviation in the landing positions are thought to be those described in (1) to (3) below. (1) Deviation in nozzle ejection position, deviation in ejection volume, ejection failure (these occurrences are referred to jointly as "ejection errors" below). (2) Deviation from the reference position of the interval Pm in the main scanning direction between dots ejected from nozzles at the head return sections shown as A and B in FIG. 20, in a case where a head having a two-dimensional nozzle arrangement such as that shown in FIG. 20 (a head having an ejection surface in which the nozzles are arranged in a two-dimensional matrix) is installed obliquely in the plane of the ejection surface with respect to the relative movement direction of the recording medium (including cases where the recording medium is conveyed at a prescribed angle with respect to the sub-scanning direction (slanted or zigzag movement)). (3) Deviation at the joints between short heads (the nozzles at the joint sections shown as C and D in FIG. 21) in a composition where short head modules 250' are joined together, as shown in FIG. 21. In FIGS. 20 and 21, reference numeral 252 indicates a pressure chamber, and a black circle inside a pressure chamber indicates a nozzle.

Japanese Patent Application Publication No. 2002-67296 discloses that treatment liquid (ink of enhanced printability) should not be deposited on regions where dots ejected from nozzles having an abnormal ejection state, or dots in the vicinity thereof, are to land. However, this means that application of treatment liquid is halted universally for all dots ejected from nozzles having an abnormal ejection state, regardless of the state of banding or the density of the image, and the like. Therefore, it cannot be regarded as providing a satisfactory solution to the aforementioned problems of systems based on the combination of two liquids. This is because dot bleeding occurs when this method is employed in low-density areas, and reduced density occurs when this method is used in high-density areas. In particular, this method is inadequate for resolving banding caused by situations (2) and (3) described above.

SUMMARY OF THE INVENTION

The present invention has been contrived in view of the foregoing circumstances, an object thereof being to provide an inkjet recording apparatus and method whereby the visibility of banding which is dependent on the dot landing positions is reduced, while at the same time, satisfactory image formation can be achieved.

In order to attain the aforementioned object, the present invention is directed to an inkjet recording apparatus, comprising: an ink ejection head in which a plurality of ink ejection ports ejecting ink are arranged; a treatment liquid ejection head in which a plurality of treatment liquid ejection ports ejecting treatment liquid are arranged; a banding information acquisition device which acquires information identifying a location where banding occurs in a dot arrangement recorded onto a recording medium by the ink ejected from the ink ejection head; an ink droplet ejection control device which controls a volume of the ink ejected by the ink ejection head according to image data; and a treatment liquid droplet ejection control device which controls droplet ejection of the treatment liquid from the treatment liquid ejection head by controlling a volume of the treatment liquid ejected from the treatment liquid ejection ports corresponding to the location where the banding occurs, as identified by the banding information acquisition device, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs.

According to the present invention, the occurrence location (position) of banding is identified, and the volume of treatment liquid in the banding location is reduced compared to the volume of treatment liquid in other locations. Therefore, the ink dots (coloring material dots) proceed to bleed in the banding location, and consequently, the banding becomes less conspicuous. Furthermore, by controlling the amount of reduction of the treatment liquid in accordance with the ink volume determined on the basis of the image data, and thus achieving a suitable amount of bleeding in accordance with the ink volume, it is possible to restrict dot bleeding in low-density regions, as well as ensuring optical density in high-density regions, and ultimately, banding can be reduced while guaranteeing the formation of an image of high quality throughout the whole image region. The present invention can be adapted to banding occurring at return sections in a two-dimensional nozzle arrangement and banding produced at the joint positions between short head modules, thereby making it possible to form images of high quality.

Preferably, a rate of reduction R(Vink) of the treatment liquid at the location where the banding occurs satisfies a relationship of R(Vink)=Ve(Vink)/V0(Vink), where Vink is the volume of the ink determined according to the image data, Ve(Vink) is the volume of the treatment liquid corresponding to Vink at the location where the banding occurs, and V0(Vink) is the volume of the treatment liquid corresponding to Vink at a location where the banding does not occur, then the rates of reduction of the treatment liquid determined for a low-density region and a medium-density region of the printed image have the following relationship:

the rate of reduction for the low-density region>the rate of reduction for the medium-density region.

In low-density regions, since banding has hardly any effect, and since decline in dot quality caused by insufficient treatment liquid can exacerbate the effects of granularity, then it is desirable to suppress dot bleeding by the use of treatment liquid in such regions. Furthermore, in medium-density regions, in order to reduce the visibility of banding, desirably, the amount of treatment liquid is adjusted in accordance with the density.

Preferably, a rate of reduction R(Vink) of the treatment liquid at the location where the banding occurs satisfies a relationship of R(Vink)=Ve(Vink)/V0(Vink), where Vink is the volume of the ink determined according to the image data, Ve(Vink) is the volume of the treatment liquid corresponding to Vink at the location where the banding occurs, and V0(Vink) is the volume of the treatment liquid corresponding to Vink at a location where the banding does not occur, then the rates of reduction of the treatment liquid determined for a medium-density region and a high-density region of the printed image have the following relationship: the rate of reduction for the high-density region>the rate of reduction for the medium-density region.

Desirably, the amount of treatment liquid is adjusted in accordance with the density, in order to reduce the visibility of banding in medium-density regions, while limiting the extent of bleeding in high-density regions, in comparison with medium-density regions, in order to ensure sufficient density.

Preferably, the treatment liquid droplet ejection control device reduces a volume per droplet of the treatment liquid ejected from the treatment liquid ejection ports corresponding to the location where the banding occurs, in comparison with a volume per droplet of the treatment liquid ejected from the treatment liquid ejection ports corresponding to the regions other than the location where the banding occurs.

One mode of a method for reducing the treatment liquid volume in the region corresponding to a banding location is to reduce the volume of treatment liquid in one droplet of treatment liquid. A mode based on changing the volume in one droplet of treatment liquid is beneficial in that it permits relatively easy control.

Alternatively, it is also preferable that the treatment liquid droplet ejection control device increases an ejection drive interval from the treatment liquid ejection ports corresponding to the location where the banding occurs, in comparison with an ejection drive interval from the treatment liquid ejection ports corresponding to the regions other than the location where the banding occurs.

As a method of reducing the volume of treatment liquid in the region corresponding to a banding location, it is also possible to adopt a mode based on lengthening the ejection drive interval for the treatment liquid, instead of, or in conjunction with, a mode based on reducing the volume of each droplet of treatment liquid. Lengthening the ejection drive interval (period) of the treatment liquid results in a thinning out of the dots of treatment liquid. Accordingly, the volume of treatment liquid per prescribed region (surface area) can be controlled.

A compositional embodiment of an ink ejection head in the inkjet recording apparatus according to the present invention is a full line type head having a row of ejection ports in which a plurality of ink ejection ports (ink droplet ejection elements for forming dots) are arranged through a length corresponding to the full width of the recording medium. In this case, a mode may be adopted in which a plurality of relatively short head modules having ejection port rows which do not reach a length corresponding to the full width of the recording medium are combined and joined together, thereby forming ejection port rows of a length that correspond to the full width of the recording medium.

A full line type head is usually disposed in a direction that is perpendicular to the relative feed direction (relative conveyance direction) of the recording medium, but a mode may also be adopted in which the ink ejection head is disposed following an oblique direction that forms a prescribed angle with respect to the direction perpendicular to the conveyance direction.

"Recording medium" indicates a medium on which an image is recorded by means of the action of the ink ejection head (this medium may also be called an image forming medium, image receiving medium, ejection receiving medium, or the like). This term includes various types of media, irrespective of material and size, such as continuous paper, cut paper, sealed paper, resin sheets, such as OHP sheets, film, cloth, an intermediate transfer body, a printed circuit board on which a wiring pattern, or the like, is formed by means of an inkjet recording apparatus, and the like.

The "conveyance device" may include a mode where the recording medium is conveyed with respect to a stationary (fixed) ejection head, or a mode where an ejection head is moved with respect to a stationary recording medium, or a mode where both the ejection head and the recording medium are moved. When forming color images, it is possible to provide ejection heads for each color of a plurality of colored inks (recording liquids), or it is possible to eject inks of a plurality of colors, from one ejection head.

Desirably, in the case of a composition which comprises a plurality of ink ejection heads for the respective colors, one treatment liquid ejection head is disposed respectively on the upstream side of the ink ejection head of each color.

In order to attain the aforementioned object, the present invention is also directed to an inkjet recording method of forming an image on a recording medium by using ink and treatment liquid; the method comprising the steps of: acquiring banding information identifying a location where banding occurs in a dot arrangement recorded onto a recording medium by ink ejected from an ink ejection head having a plurality of ink ejection ports; performing ink droplet ejection control to control a volume of the ink ejected by the ink ejection head according to image data; and performing treatment liquid droplet ejection control to control droplet ejection of treatment liquid from a treatment liquid ejection head having a plurality of treatment liquid ejection ports, by controlling a volume of the treatment liquid ejected from the treatment liquid ejection ports corresponding to the location where the banding occurs, as identified in the banding information acquiring step, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs.

According to the present invention, a composition is adopted in which the location of banding is identified, and treatment liquid is deposited on the medium while reducing the amount of treatment liquid deposited onto the location where banding occurs. Therefore, the visibility of banding, which is dependent on the dot landing positions, is reduced, and it is possible to form image of high quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
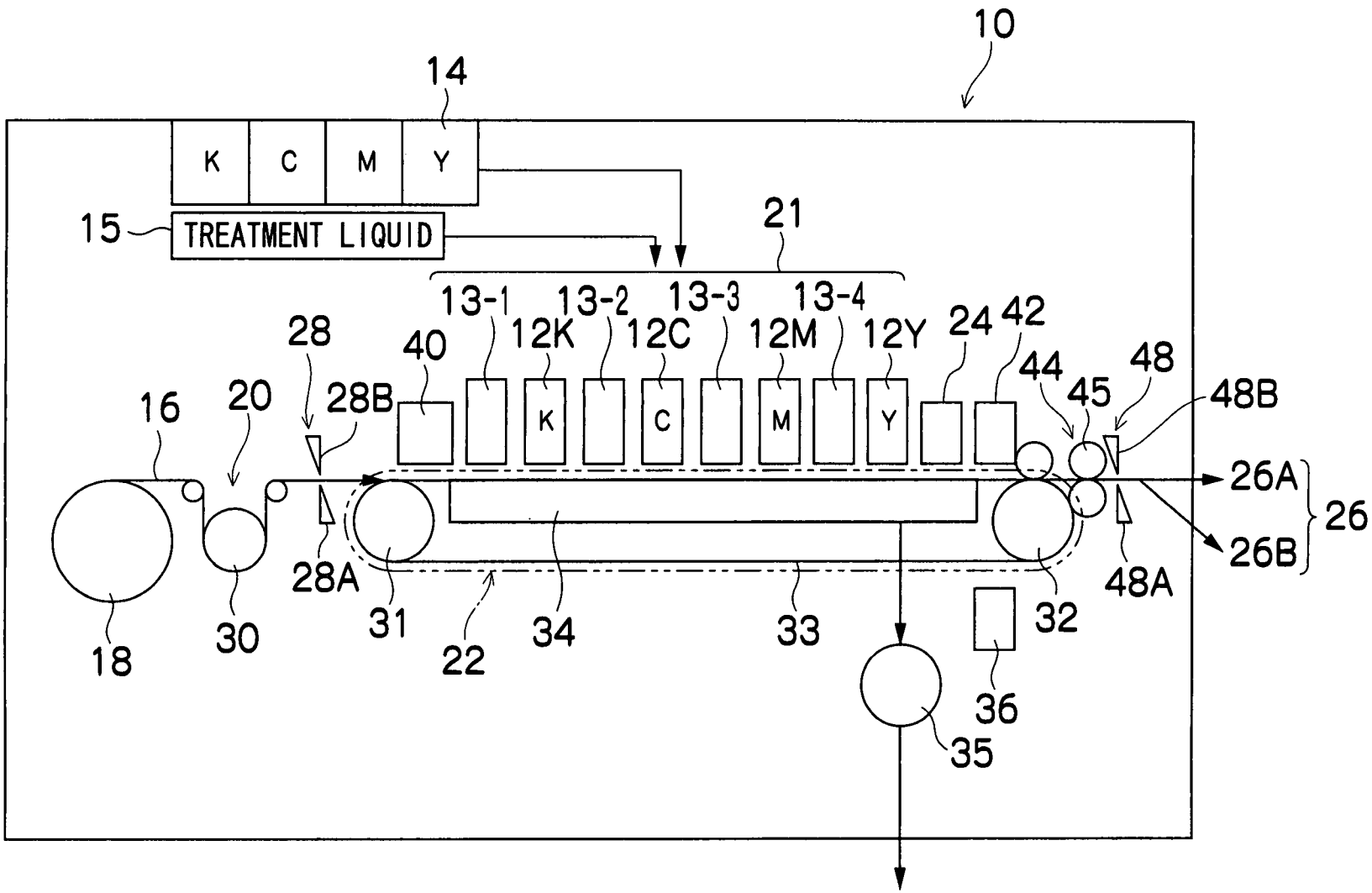
FIG. 1 is a general schematic drawing of an inkjet recording apparatus relating to one embodiment of the present invention.

FIG. 1 is a diagram of the general composition of an inkjet recording apparatus according to an embodiment of the present invention. As shown in FIG. 1, the inkjet recording apparatus 10 is equipped with a plurality of ink droplet ejection heads (corresponding to ink ejection devices) 12K, 12C, 12M and 12Y (in this case, one head for each ink color) for ejecting inks of the respective colors of black (K), magenta (M), cyan (C) and yellow (Y), and is also equipped with treatment liquid droplet ejection heads (corresponding to treatment liquid deposition devices) 13-1 to 13-4 for ejecting treatment liquid which reacts with the ink, disposed respectively on the upstream side (front stage) of the ink droplet ejection heads 12K, 12C, 12M and 12Y of the respective colors. Furthermore, the inkjet recording apparatus 10 also comprises: an ink storing and loading unit 14 which stores colored inks to be supplied to the ink droplet ejection heads 12K, 12C, 12M and 12Y; a treatment liquid storing and loading unit 15 which stores treatment liquid to be supplied to the respective treatment liquid droplet ejection heads 13-1 to 13-4; a medium supply unit 18 which supplies recording medium 16; a decurling unit 20 for removing curl from the recording medium 16; a belt conveyance unit 22 forming a device for conveying the recording medium; a print determination unit 24 which reads in the print result; and an output unit 26 which outputs the recorded recording medium 16 (printed matter), to the exterior.

The ink storing and loading unit 14 has ink tanks for storing the inks of K, C, M and Y to be supplied to the ink droplet ejection heads 12K, 12C, 12M, and 12Y, and the tanks are connected to the ink droplet ejection heads 12K, 12C, 12M, and 12Y of the print unit 21 by means of prescribed channels (not shown). The ink storing and loading unit 14 has a warning device (for example, a display device or an alarm sound generator) for warning when the remaining amount of any ink is low, and has a mechanism for preventing loading errors among the colors.

The treatment liquid storing and loading unit 15 has a treatment liquid tank which stores treatment liquid, and the treatment liquid tank is connected to the treatment liquid droplet ejection heads 13-1 to 13-4 of the print unit 21 through prescribed channels (not shown). Similarly to the ink storing and loading unit 14, the treatment liquid storing and loading unit 15, also comprises a warning device (for example, a display device or an alarm sound generator) for warning when the remaining amount of any treatment liquid is low, and has a mechanism for preventing loading errors among the treatment liquids.

The ink used in the present embodiment is, for instance, colored ink including anionic polymer, namely, a polymer containing negatively charged surface-active ions. Furthermore, the treatment liquid used in the present embodiment is, for instance, a transparent reaction promotion agent including cationic polymer, namely, a polymer containing positively charged surface-active ions.

When ink and treatment liquid are mixed, an insolubilization and/or fixing reaction of the coloring material in the ink proceeds due to a chemical reaction. Here, the term "insolubilization" includes a phenomenon whereby the coloring material separates or precipitates from the solvent, a phenomenon whereby the liquid in which the coloring material is dissolved changes (coagulates) to a solid phase, or a phenomenon whereby the liquid increases in viscosity and hardens. Furthermore, the term "fixing" may indicate a mode where the coloring material is held on the surface of the recording medium 16, a mode where the coloring material permeates into the recording medium 16 and is held therein, or a mode combining these states.

The reaction speed and the characteristics of the respective liquids (surface tension, viscosity, or the like) can be adjusted by regulating the respective compositions of the ink and treatment liquids, the concentration of the materials contributing to the reaction, or the like, and desired ink insolubility and/or ink fixing properties (hardening speed, fixing speed, or the like) can be achieved.

In FIG. 1, with regard to the supply system of the recording medium 16, a magazine for rolled paper (continuous paper) is shown as an embodiment of the medium supply unit 18; however, more magazines with paper differences such as paper width and quality may be jointly provided. Moreover, papers (recording medium) may be supplied with cassettes that contain cut papers loaded in layers and that are used jointly or in lieu of the magazine for rolled paper.

In the case of a configuration in which a plurality of types of recording medium can be used, it is preferable that an information recording medium such as a bar code and a wireless tag containing information about the type of recording medium is attached to the magazine, and by reading the information contained in the information recording medium with a predetermined reading device, the type of recording medium to be used (type of medium) is automatically determined, and ejection is controlled so that the treatment liquid and ink are ejected in an appropriate manner in accordance with the type of medium.

The recording medium 16 delivered from the medium supply unit 18 retains curl due to having been loaded in the magazine. In order to remove the curl, heat is applied to the recording medium 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording medium 16, and a round blade 28B, which moves along the stationary blade 28A. The stationary blade 28A is disposed on the reverse side of the printed surface of the recording medium 16, and the round blade 28B is disposed on the printed surface side across the conveyor pathway. When cut papers are used, the cutter 28 is not required.

After decurling in the decurling unit, the cut recording medium 16 is delivered to the belt conveyance unit 22. The belt conveyance unit 22 is disposed so as to oppose the nozzle surface (liquid ejection surface) of the print unit 21, and it conveys the recording medium 16 while keeping the recording medium 16 flat. The belt conveyance unit 22 of the present embodiment has a configuration in which an endless belt 33 is set around rollers 31 and 32 so that the portion of the endless belt 33 facing at least the nozzle face of the printing unit 21 and the sensor face of the print determination unit 24 forms a horizontal plane (flat plane).

The belt 33 has a width that is greater than the width of the recording medium 16, and a plurality of suction apertures (not shown) are formed on the belt surface. A suction chamber 34 is disposed in a position facing the sensor surface of the print determination unit 24 and the nozzle surface of the printing unit 21 on the interior side of the belt 33, which is set around the rollers 31 and 32, as shown in FIG. 1. The suction chamber 34 provides suction with a fan 35 to generate a negative pressure, and the recording medium 16 is held on the belt 33 by suction.

The belt 33 is driven in the clockwise direction in FIG. 1 by the motive force of a motor 88 (shown in FIG. 7) being transmitted to at least one of the rollers 31 and 32, which the belt 33 is set around, and the recording medium 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording medium 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable. Further, the means for conveying the recording medium 16 can be configured using the electrostatic suction method instead of the adsorption-suction method described above.

The ink droplet ejection heads 12K, 12M, 12C and 12Y and the treatment liquid droplet ejection heads 13-1 to 13-4 of the print unit 21 are full line heads having a length corresponding to the maximum width of the recording medium 16 used with the inkjet recording apparatus 10, and comprising nozzles for ejecting ink or nozzles for ejecting treatment liquid arranged on a nozzle face through a length exceeding at least one edge of the maximum-size recording paper (namely, the full width of the printable range).

As shown in FIG. 1, the ink droplet ejection heads 12K, 12C, 12M and 12Y of the print unit 21 are arranged in the sequence of the colors, black (K), cyan (C), magenta (M) and yellow (Y), from the upstream side, in terms of the direction of conveyance of the recording medium 16, and the treatment liquid droplet ejection heads 13-1 to 13-4 are disposed respectively to the upstream side of each of the color heads. These heads 12K, 12C, 12M and 12Y are disposed in fixed positions in such a manner that they extend in a direction substantially perpendicular to the conveyance direction of the recording medium 16. By means of this head arrangement, before droplets of colored inks are deposited by the ink droplet ejection heads 12K, 12C, 12M and 12Y, treatment liquid can be deposited on the printing surface (recording surface) of the recording medium 16 by the treatment liquid droplet ejection heads 13-1 to 13-4. Furthermore, a color image can be formed on the recording medium 16 by ejecting inks of different colors from the ink droplet ejection heads 12K, 12M, 12C and 12Y, respectively, onto the recording medium 16, while it is conveyed by the belt conveyance unit 22.

By adopting a configuration in which the full line ink droplet ejection heads 12K, 12C, 12M and 12Y having nozzle rows covering the full paper width are provided for the respective colors in this way, it is possible to record an image on the full surface of the recording medium 16 by performing just one operation of relatively moving the recording medium 16 and the printing unit 21 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 comprises an image sensor for capturing an image of the droplet ejection results of the print unit 21, and it functions as a device for acquiring information relating to density non-uniformities from the droplet ejection image read out by the image sensor, as well as also functioning as a device for checking ejection errors, such as nozzle blockages, deviation of the landing positions, and the like.

The print determination unit 24 of the present embodiment is configured with at least a line sensor having rows of photoelectric transducing elements with a width that is greater than the ink ejection width (image recording width) of the ink droplet ejection heads 12K, 12C, 12M, and 12Y of respective colors. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the ink droplet ejection heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

The print determination unit 24 here is taken to have an imaging range which is capable of capturing an image of at least the whole region of the ink ejection width (image recording width) of the ink droplet ejection heads 12K, 12C, 12M and 12Y, but it is also possible to achieve the prescribed imaging range by means of one line sensor (or area sensor), and it is also possible to ensure the prescribed imaging range by combining (joining together) a plurality of line sensors (or area sensors). Alternatively, a composition may be adopted in which a line sensor (or area sensor) is supported on a movement mechanism (not shown), and an image of the required imaging range is scanned by the moving sensor.

Furthermore, it is also possible to use a line sensor instead of the area sensor. In this case, a desirable composition is one in which the line sensor has rows of photoreceptor elements (rows of photoelectric transducing elements) with a width that is greater than the ink droplet ejection width (image recording width) of the ink droplet ejection heads 12K, 12C, 12M and 12Y.

An image (actual image) in which a test pattern or the desired image is printed (recorded) by at least one of the ink droplet ejection heads 12K, 12C, 12M and 12Y in the print unit 21 is read in by the print determination unit 24, and evaluation of density non-uniformities (banding) or evaluation of the ejection from each head, is performed. The ejection determination includes the presence of the ejection, measurement of the dot size, and measurement of the dot landing position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the output unit 26. The target print and the test print (i.e., the result of printing the test pattern) are preferably outputted separately. In the inkjet recording apparatus 10 according to the present embodiment, a sorting device (not shown) is provided for switching the outputting pathways in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head will be described. The ink droplet ejection heads 12K, 12C, 12M and 12Y of the respective ink colors have the same structure, and a reference numeral 50 is hereinafter designated to any of the heads.

Figure 2A:
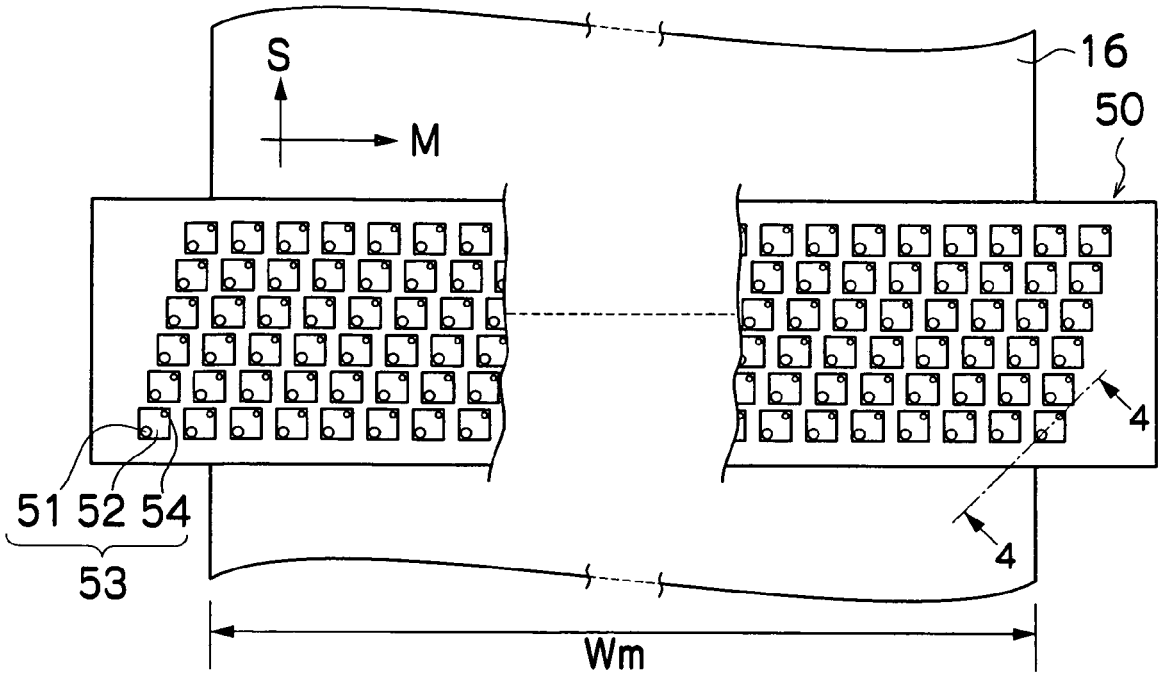
FIGS. 2A and 2B are plan view perspective diagrams showing an embodiment of the composition of an ink droplet ejection head.
Figure 2B:
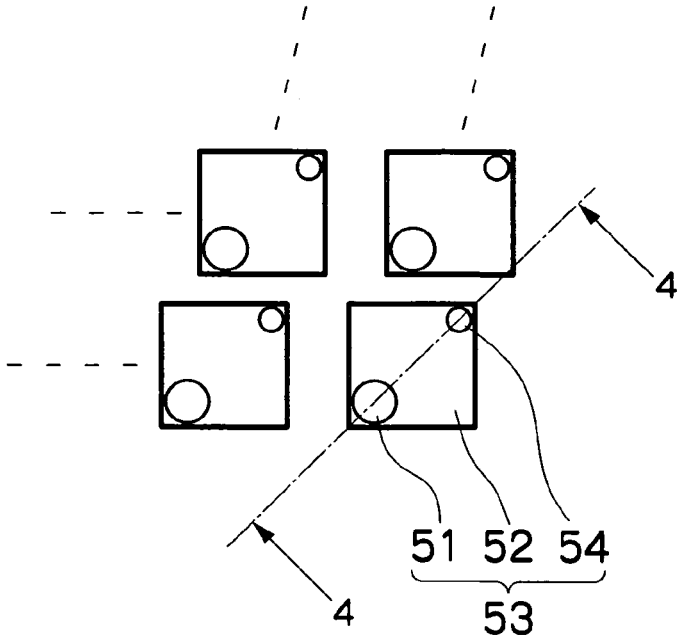

FIG. 2A is a perspective plan view showing an embodiment of the configuration of the head 50, FIG. 2B is an enlarged view of a portion thereof. The nozzle pitch in the ink droplet ejection head 50 should be minimized in order to maximize the density of the dots printed on the surface of the recording medium 16. As shown in FIGS. 2A and 2B, the ink droplet ejection head 50 according to the present embodiment has a structure in which an ink chamber unit (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

Figure 3:
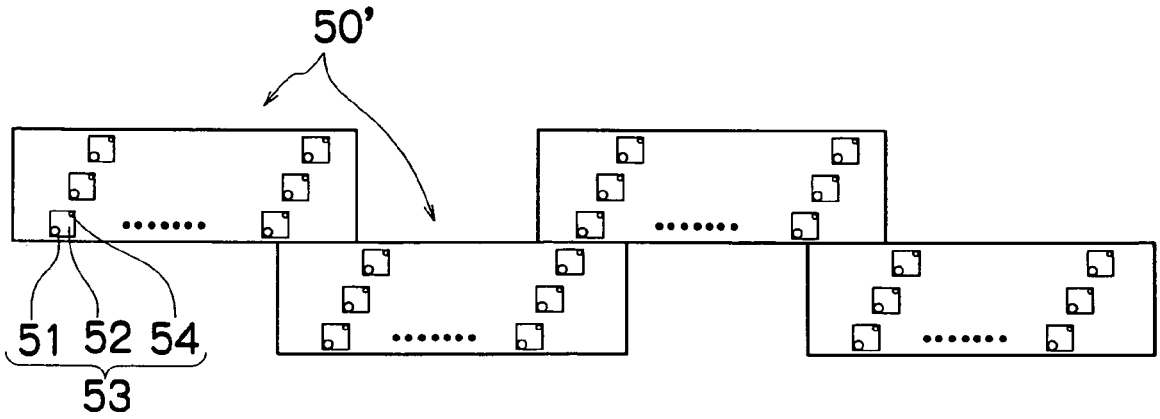
FIG. 3 is a plan view perspective diagram showing a further embodiment of the composition of a full line head.

The invention is not limited to the present embodiment of a mode for constituting nozzle rows equal to or exceeding a length corresponding to the full width Wm of the recording medium 16 in a direction (indicated by arrow M; main scanning direction) which is substantially perpendicular to the feed direction of the recording medium 16 (indicated by arrow S; sub-scanning direction). For example, instead of the composition in FIG. 2A, as shown in FIG. 3, a line head having nozzle rows of a length corresponding to the entire width of the recording medium 16 can be formed by arranging and combining, in a staggered matrix, short head modules 50' each having a plurality of nozzles 51 arrayed in a two-dimensional fashion.

As shown in FIGS. 2A and 2B, the planar shape of the pressure chamber 52 provided for each nozzle 51 is substantially a square, and an outlet to the nozzle 51 and an inlet of supplied ink (supply port) 54 are disposed in both corners on a diagonal line of the square. The shape of the pressure chamber 52 is not limited to that of the present embodiment and various modes are possible in which the planar shape is a diamond shape, a rectangular shape, a pentagonal shape, a hexagonal shape, or other polygonal shape, or a circular shape, elliptical shape, or the like.

Figure 4:
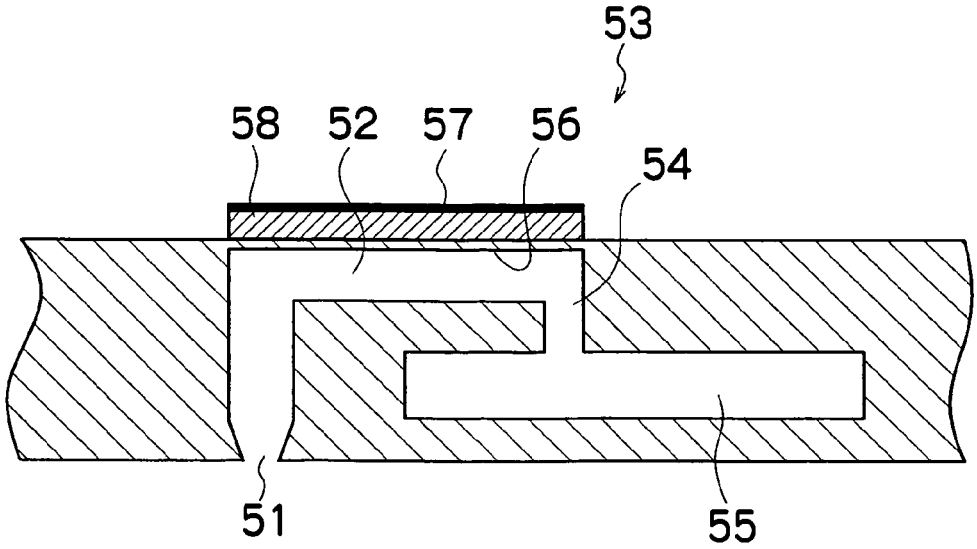
FIG. 4 is a cross-sectional view along line 4-4 in FIGS. 2A and 2B.

FIG. 4 is a cross-sectional diagram along line 4-4 in FIGS. 2A and 2B, and shows the three-dimensional composition of one of the liquid droplet ejection elements (an ink chamber unit corresponding to one nozzle 51). As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank is delivered through the common flow channel 55 in FIG. 4 to the pressure chambers 52.

An actuator 58 provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57, the actuator 58 deforms, thereby changing the volume of the pressure chamber 52. This causes a pressure change which results in ink being ejected from the nozzle 51. When the displacement of the actuator 58 returns to its original position after ejecting ink, new ink is supplied from the common channel 55 to the pressure chamber 52 through the supply port 54. For the actuator 58, it is possible to use a piezoelectric element using a piezoelectric body, such as lead zirconate titanate, barium titanate, or the like.

Figure 5:
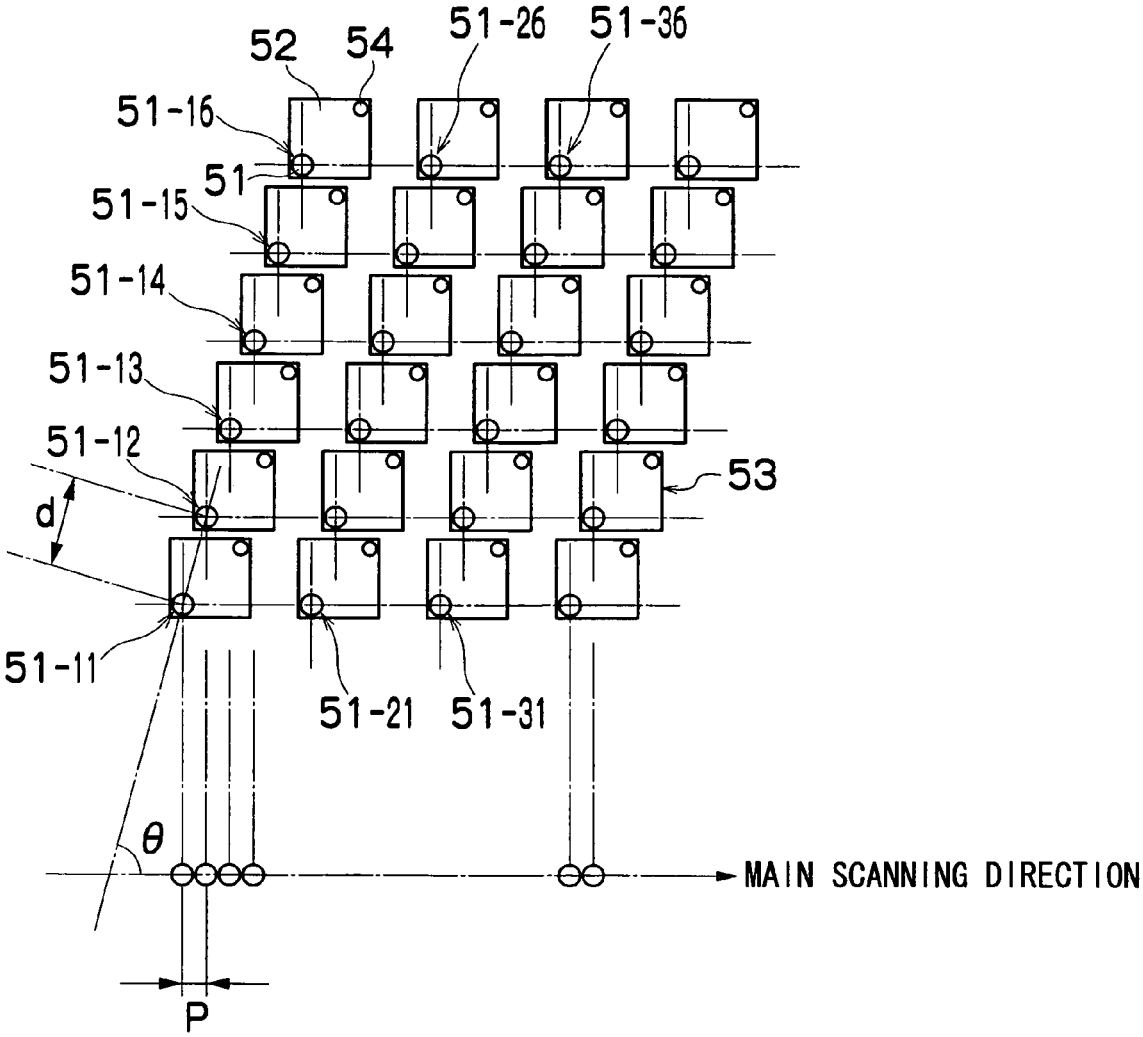
FIG. 5 is an enlarged view showing an embodiment of the arrangement of ink chamber units (liquid ejection elements) in a head.

By arranging a plurality of ink chamber units 53 having this structure in a lattice configuration based on a fixed arrangement pattern having a row direction aligned with the main scanning direction and an oblique column direction having a uniform non-perpendicular angle of θ with respect to the main scanning direction, as shown in FIG. 5, the effective distance between the nozzles when projected to an alignment in the main scanning direction (a direction perpendicular to the recording medium conveyance direction), in other words, the projected nozzle pitch, is reduced, and high density arrangement of the nozzles can be achieved.

More specifically, by adopting a structure in which a plurality of ink chamber units 53 are arranged at a uniform pitch d in line with a direction forming an angle of θ with respect to the main scanning direction, the pitch P of the nozzles projected to an alignment in the main scanning direction is $d \times \cos\theta$, and hence it is possible to treat the nozzles 51 as if they are arranged linearly at a uniform pitch of P. By adopting a composition of this kind, it is possible to achieve nozzle rows of high density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording medium 16 by sequentially driving the nozzles 51-11, 51-12, . . . , 51-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while moving the full-line head and the recording medium (paper) relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording medium 16 is called the sub-scanning direction and the direction perpendicular to same is called the main scanning direction.

In implementing the present invention, the arrangement of the nozzles is not limited to that of the embodiment illustrated. Moreover, a method is employed in the present embodiment where an ink droplet is ejected by means of the deformation of the actuator 58, which is typically a piezoelectric element; however, in implementing the present invention, the method used for ejecting ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Although not shown in the drawings, the detailed structure of the treatment liquid droplet ejection heads 13-1 to 13-4 is generally the same as that of the ink droplet ejection head 50 shown in FIGS. 2A to 5. Since the treatment liquid should be deposited on the recording medium 16 in a substantially uniform (even) fashion in the region where ink droplets are to be ejected, it is not necessary to form treatment liquid dots to a high density, in comparison with the ink. Consequently, the treatment liquid droplet ejection heads 13-1 to 13-4 may also be composed with a reduced number of nozzles (a reduced nozzle density) in comparison with the ink droplet ejection head 50. Furthermore, a composition may also be adopted in which the nozzle diameter of the treatment liquid droplet ejection heads 13-1 to 13-4 is greater than the nozzle diameter of the ink droplet ejection head 50.

Composition of Ink Supply System

Figure 6:
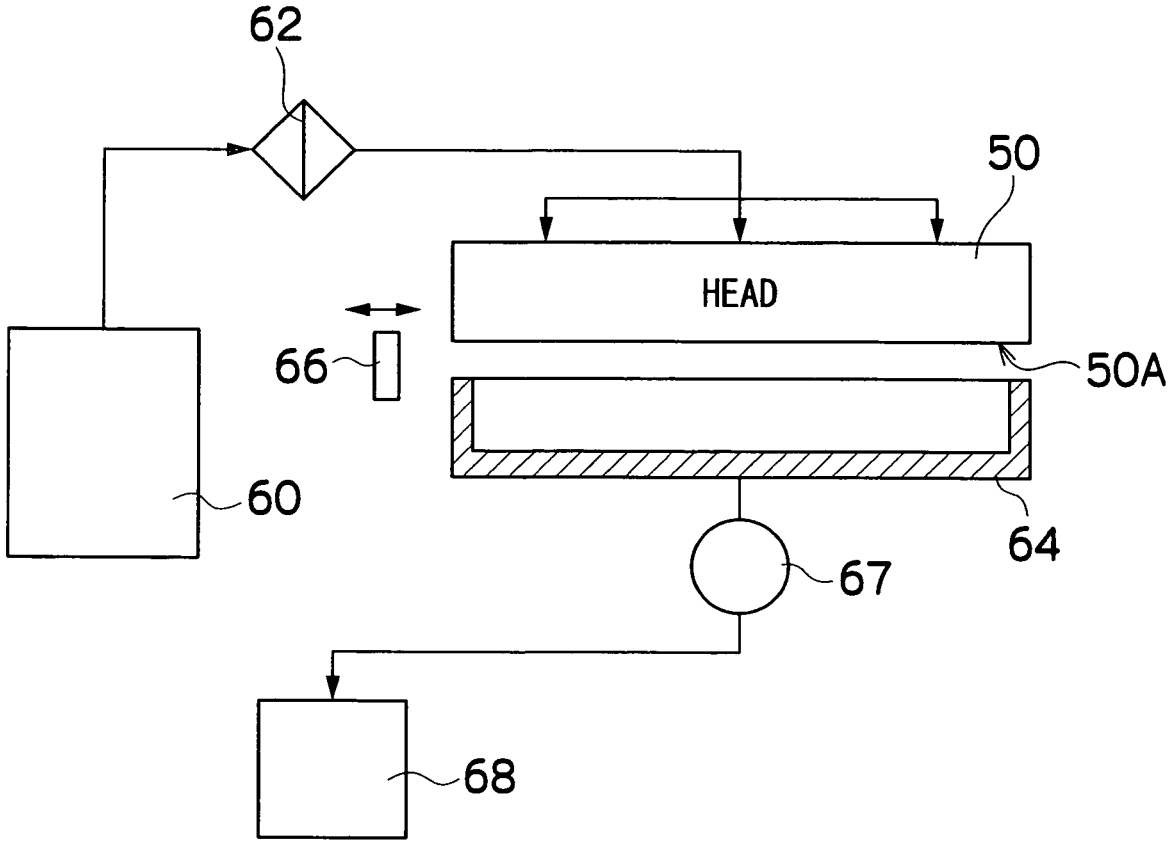
FIG. 6 is a schematic drawing showing the composition of an ink supply system in the inkjet recording apparatus according to the present embodiment.

FIG. 6 is a conceptual diagram showing the composition of an ink supply system in the inkjet recording apparatus 10. The ink tank 60 is a base tank for supplying ink to the ink droplet ejection head 50, which is disposed in the ink storing and loading unit 14 shown in FIG. 1. In other words, the ink supply tank 60 in FIG. 6 is equivalent to the ink storing and loading unit 14 in FIG. 1. The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

A filter 62 for removing foreign matters and bubbles is disposed between the ink tank 60 and the ink droplet ejection head 50 as shown in FIG. 6. The filter mesh size in the filter 62 is preferably equivalent to or less than the diameter of the nozzle. Although not shown in FIG. 6, it is preferable to provide a sub-tank integrally to the ink droplet ejection head 50 or nearby the ink droplet ejection head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoration device) including the cap 64 and the cleaning blade 66 can be relatively moved with respect to the ink droplet ejection head 50 by a movement mechanism (not shown), and is moved from a predetermined holding position to a maintenance position below the ink droplet ejection head 50 as required.

The cap 64 is displaced up and down relatively with respect to the ink droplet ejection head 50 by an elevator mechanism (not shown). When the power of the inkjet recording apparatus 10 is turned OFF or when in a print standby state, the cap 64 is raised to a predetermined elevated position so as to come into close contact with the ink droplet ejection head 50, and the nozzle face 50A is thereby covered with the cap 64.

The cleaning blade 66 is composed of rubber or another elastic member, and can slide on the nozzle surface 50A (nozzle plate surface) of the ink droplet ejection head 50 by means of a blade movement mechanism (not shown). If there are ink droplets or foreign matter adhering to the nozzle plate surface, then the nozzle plate surface is wiped clean by causing the cleaning blade 66 to slide over the nozzle plate.

During printing or standby, when the frequency of use of specific nozzles is reduced and ink viscosity increases in the vicinity of the nozzles, a preliminary discharge is made to eject the degraded ink toward the cap 64 (also used as an ink receptor).

When a state in which ink is not ejected from the ink droplet ejection head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the ink droplet ejection head 50, and the ink inside the pressure chambers 52 (namely, the ink containing air bubbles of the ink of increased viscosity) is suctioned by a suction pump 67. The ink suctioned and removed by means of this suction operation is sent to a recovery tank 68. The ink collected in the recovery tank 68 may be used, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suction operation is also carried out when ink is loaded into the ink droplet ejection head 50 for the first time, and when the head starts to be used after being idle for a long period of time.

The supply system and the cleaning device for the treatment liquid are not shown, but they have the same composition as the ink supply system and cleaning device shown in FIG. 6.

Description of Control System

Figure 7:
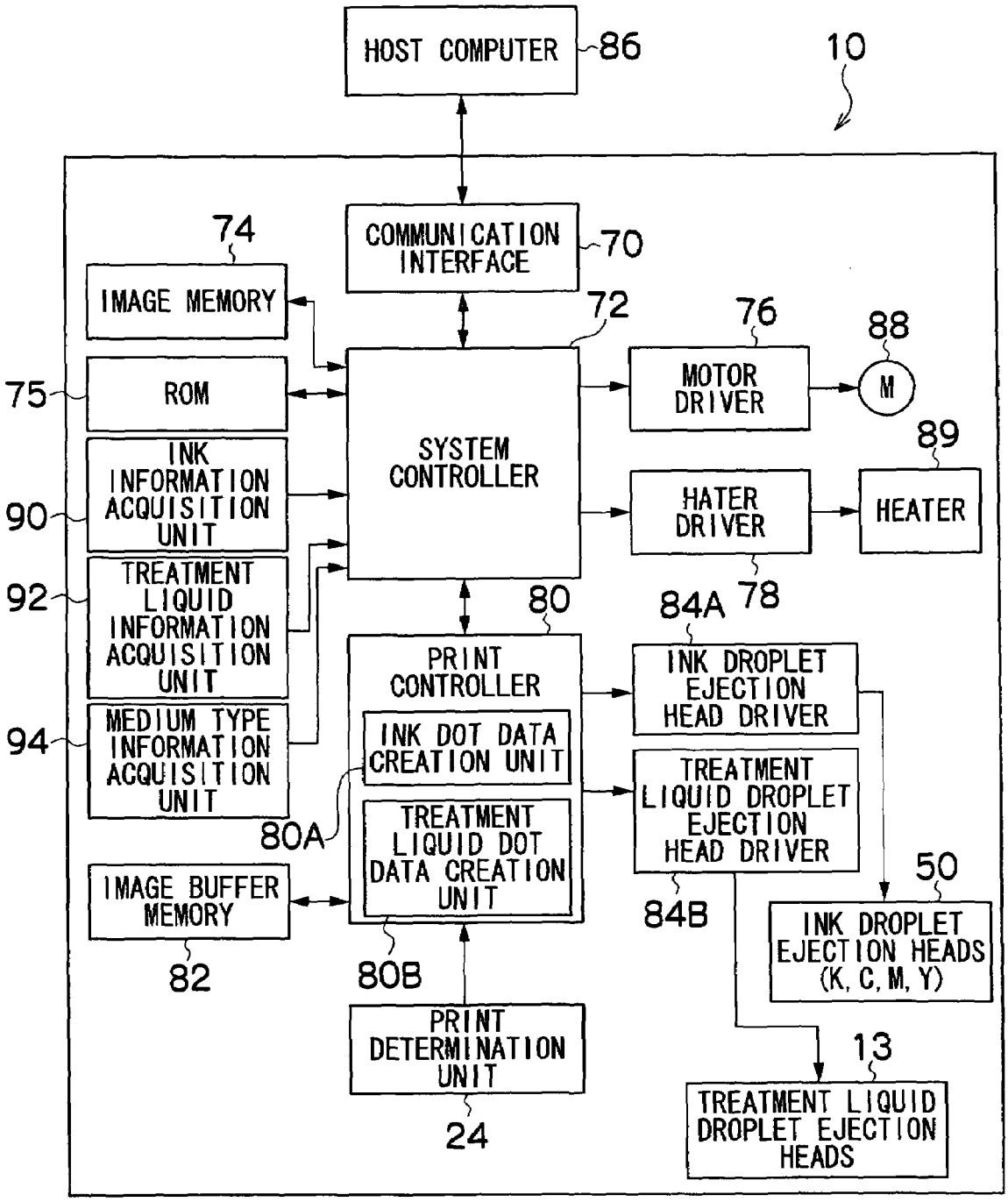
FIG. 7 is a principal block diagram showing the system composition of an inkjet recording apparatus according to the present embodiment.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, an ink droplet ejection head driver 84A, a treatment liquid droplet ejection head driver 84B, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 and heater 89 of the conveyance system.

The program executed by the CPU of the system controller 72 and the various types of data (including data for printing a test pattern for evaluation of density non-uniformities) which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 has a signal processing function forming an ink dot data creation unit 80A for generating dot data for the inks of respective colors, on the basis of the input image, and a signal processing function forming a treatment liquid dot data creation unit 80B for generating dot data for the treatment liquid. The print controller 80 is a control unit which, under the control of the system controller 72, carries out various processing, correctional operations, and the like, in order to generate an ink droplet ejection control signal and a treatment liquid droplet ejection control signal, from the image data in the image memory 74, and it supplies the generated ink dot data to the ink droplet ejection head driver 84A, while also supplying the generated treatment liquid dot data to the treatment liquid droplet ejection head driver 84B.

An image buffer memory 82 is provided in the print controller, and image data, parameters, and other data are temporarily stored in the image buffer memory 82 when image data is processed in the print controller 80. FIG. 7 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source through a communications interface 70, and is accumulated in the image memory 74. At this stage, RGB image data is stored in the image memory 74, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 74 is sent to the print controller 80 through the system controller 72, and is converted to the dot data for each ink color by a half-toning technique, using dithering, error diffusion, or the like, in the print controller 80.

In other words, the print controller 80 performs processing for converting the input RGB image data into dot data for the four colors of K, C, M and Y. Furthermore, the print controller 80 carries out processing for generating treatment liquid dot data, on the basis of the dot data of the respective colors of ink. The ink dot data and the treatment liquid dot data generated by the print controller 80 in this way are stored in the image buffer memory 82.

The ink droplet ejection head driver 84A outputs drive signals for driving the actuators 58 corresponding to the respective nozzles 51 of the ink droplet ejection head 50, on the basis of the ink dot data (in other words, the ink dot data stored in the image buffer memory 82) supplied by the print controller 80. Similarly, the treatment liquid droplet ejection head driver 84B outputs drive signals for driving the actuators corresponding to the nozzles of the treatment liquid droplet ejection heads 13 (indicated by reference numeral 13 in FIG. 7 to represent the reference numerals 13-1 to 13-4 shown in FIG. 1), on the basis of treatment liquid dot data supplied by the print controller 80 (in other words, the treatment liquid dot data stored in the image buffer memory 82).

The ink droplet ejection head driver 84A and the treatment liquid droplet ejection head driver 84B may also respectively comprise a feedback control system for maintaining uniform drive conditions in the heads.

By supplying the drive signals output by the treatment liquid droplet ejection head driver 84B to the treatment liquid droplet ejection head 13, treatment liquid is ejected from the corresponding nozzles. By supplying the drive signals output by the ink droplet ejection head driver 84A to the ink droplet ejection head 50, ink is ejected from the corresponding nozzles 51. By controlling the ejection of treatment liquid from the treatment liquid droplet ejection head 13 and the ejection of ink from the ink droplet ejection head 50 in synchronism with the conveyance speed of the recording medium 16, an image is formed on the recording medium 16.

As described above, the ejection volume and the ejection timing of the liquid droplets from the treatment liquid droplet ejection head 13 and the ink droplet ejection head 50 are controlled, on the basis of the dot data generated by implementing prescribed signal processing in the print controller 80. By this means, prescribed dot size and dot positions can be achieved.

As shown in FIG. 1, the print determination unit 24 is a block including an image sensor, which reads in the image printed onto the recording medium 16, performs various signal processing operations, and the like, and determines the print situation (presence/absence of ejection, variation in droplet ejection, optical density, and the like), these determination results being supplied to the print controller 80.

According to requirements, the print controller 80 makes various corrections with respect to the ink droplet ejection head 50 on the basis of information obtained from the print determination unit 24. Furthermore, the system controller 72 implements control (details of which are described hereinafter) for adjusting the ejection volume of the treatment liquid, on the basis of the information obtained from the print determination unit 24, as well as implementing prescribed restoration processes, such as preliminary ejection, suction, and the like, as and when necessary. In other words, the print determination unit 24 functions as a "banding information acquisition device" according to the present invention, and the system controller 72 or the printer controller 80, or a combination of the system controller 72 and the print controller 80, function as an "ink droplet ejection control device" and a "treatment liquid droplet ejection control device" according to the present invention.

Furthermore, the inkjet recording apparatus 10 comprises: an ink information acquisition unit 90 which acquires information relating to the type of ink used (information on the type of ink); a treatment liquid information acquisition unit 92 which acquires information relating to the type of treatment liquid (information on the type of treatment liquid); and a medium type information acquisition unit 94 which acquires information relating to the type of recording medium 16 (medium type). The information obtained from these various sections is supplied to the system controller 72.

For the device for acquiring information on the ink type, it is possible to use, for example, a device which reads in ink properties information from the shape of the cartridge in the ink tank (a specific shape which allows the ink type to be identified), or from a bar code or IC chip incorporated into the cartridge. Besides this, it is also possible for an operator to input the required information by means of a user interface.

For the device for acquiring information on the type of treatment liquid, similarly to the device for acquiring information on the type of ink, it is possible to use, for example, a device which reads in treatment liquid properties information from the shape of the cartridge in the treatment liquid tank (a specific shape which allows the type of treatment liquid to be identified), or from a bar code or IC chip incorporated into the cartridge. Besides this, it is also possible for an operator to input the required information by means of a user interface.

The medium type information acquisition unit 94 is a device for determining the type and size of the recording medium 16. This section uses, for example, a device for reading in information such as a bar code attached to the magazine in the medium supply unit 18 shown in FIG. 1, or a sensor disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of inputs made through a prescribed user interface, instead of or in conjunction with such automatic determination devices.

The system controller 72 and the print controller 80 control the treatment liquid volume and ink volume (the liquid droplet size, ejection drive timings, or a combination of same), on the basis of the information obtained from the ink information acquisition unit 90, the treatment liquid information acquisition unit 92 and the medium type information acquisition unit 94.

Treatment Liquid Droplet Ejection Method

Next, a method for controlling the droplet ejection of treatment liquid and ink in an inkjet recording apparatus 10 having the composition described above will be explained.

Figure 8:
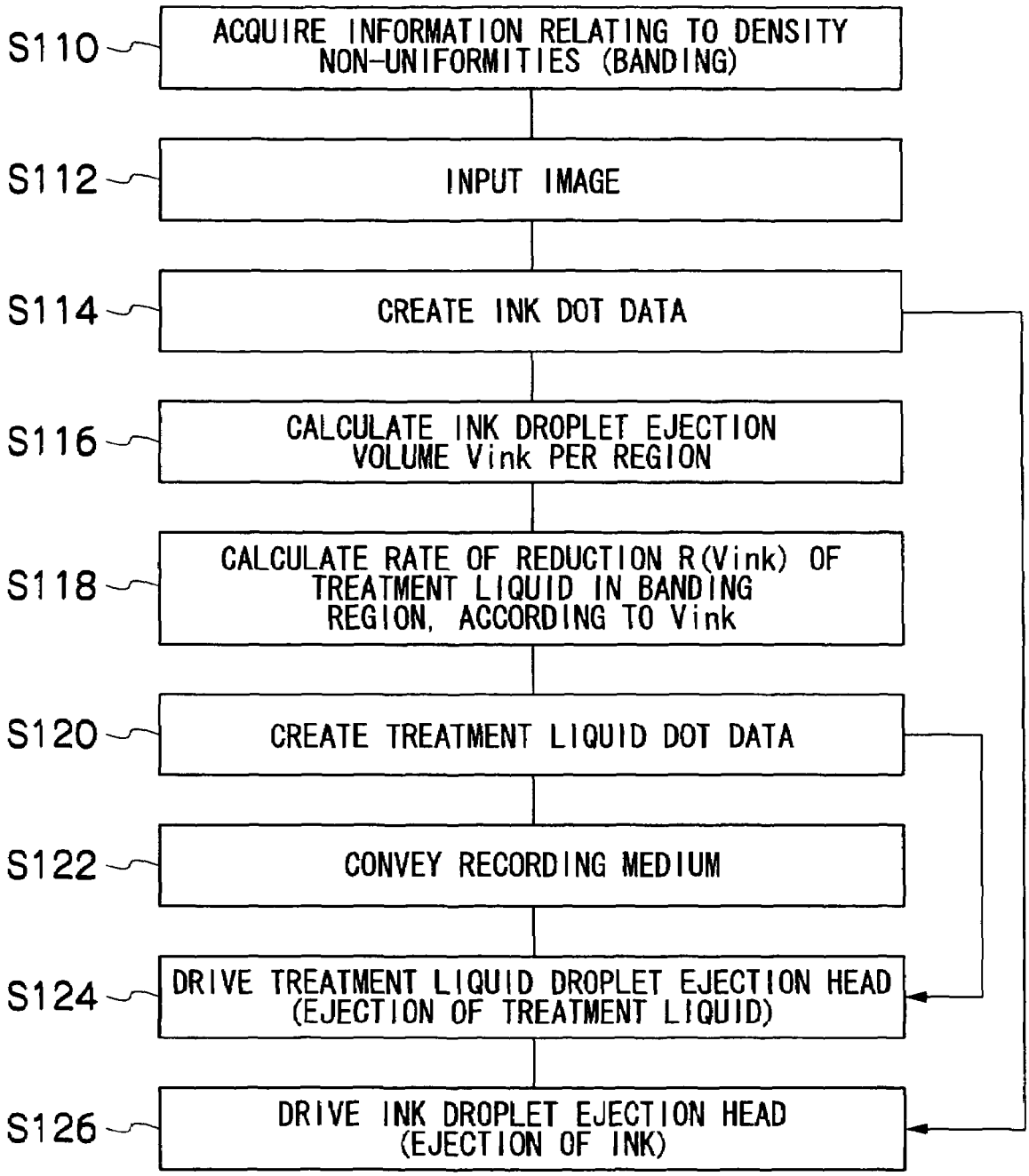
FIG. 8 is a flowchart showing a procedure of treatment liquid and ink droplet ejection control.

FIG. 8 is a flowchart showing a procedure of treatment liquid and ink droplet ejection control. As shown in FIG. 8, firstly, information relating to density non-uniformities (banding) is acquired (step S110). As a concrete acquisition method, for example, a prescribed dot pattern or a solid image is printed as a test print, and this print is read in by the print determination unit 24, or the like. Of course, it is also possible to adopt a mode in which the results of the test print are read in by a scanner (not shown), and information relating to non-uniformities in density are acquired. If the cause of the non-uniformity in density is the cause (1) described above in the "Description of the Related Art" (namely, if the nozzle itself produces an error), then the state of the ejection error changes with cleaning, and the like, and the banding situation changes accordingly. Therefore, desirably, information relating to density non-uniformities (banding) should be acquired, each time cleaning is performed. However, in the case of the causes (2) and (3) described above in the "Description of the Related Art", the banding situation does not change, provided that the head is not replaced or exchanged, and therefore, once acquired information has been stored in the memory (for example, EEPROM), or the like, then it is possible to continue to use the same information.

After step S110, the data of the image to be printed is read in (step S112), whereupon the input image is developed into ink dot data (dot data for the respective colors) (step S114). The printing region is then divided into a mesh of a prescribed size, and the ink droplet ejection volume Vink inside that region is calculated on the basis of the dot data (step S116). Desirably, the size of the mesh has edges of approximately 100 μm, taking account of the limitations of human visual observation.

Thereupon, a reduction rate R(Vink) of the treatment liquid in the banding region is determined on the basis of the ink droplet ejection volume Vink for the region determined at step S116, and the banding information acquired at step S110 (step S118). Here, the reduction rate R(Vink) is defined as:

$$R(Vink)=Ve(Vink)/V0(Vink), \quad (1)$$

where Ve(Vink) is the treatment liquid droplet ejection volume at a position where banding occurs, V0(Vink) is the treatment liquid droplet ejection volume at a position where banding does not occur, and both are determined by the ink droplet ejection volume Vink (namely, both are functions of the ink droplet ejection volume Vink).

Figure 9:
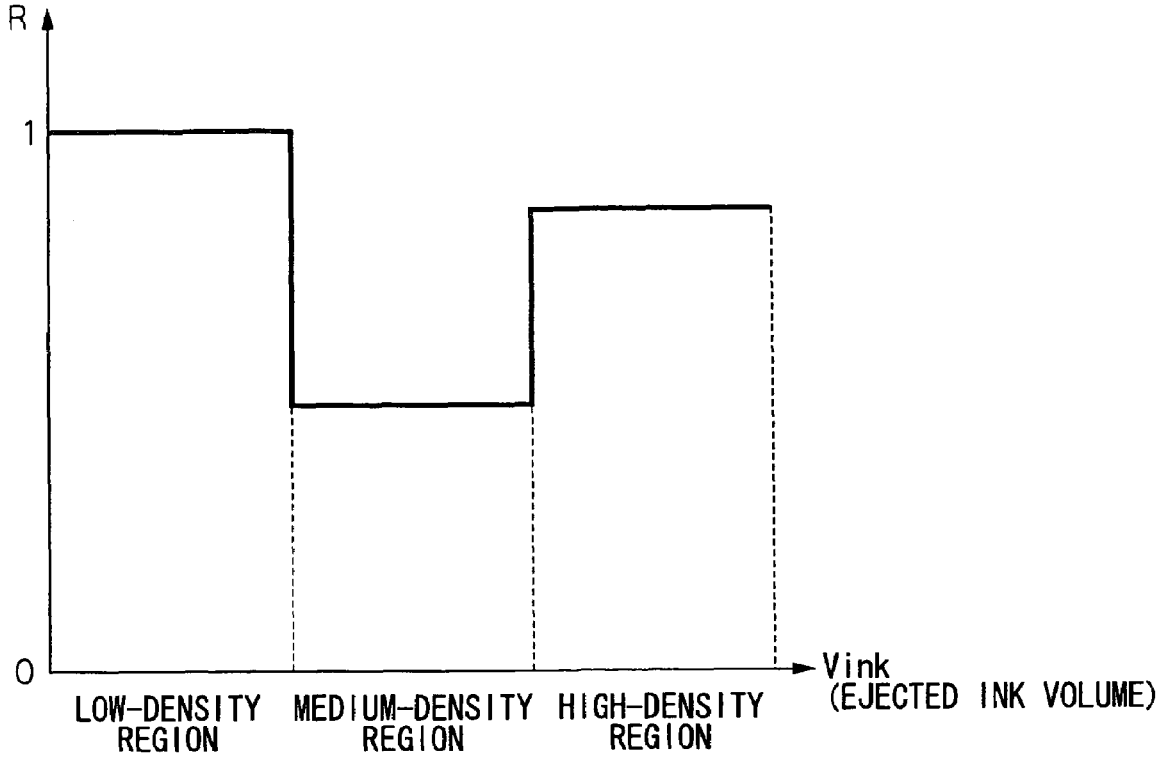
FIG. 9 is a graph showing an example of the change in the reduction rate R of the treatment liquid, with respect to the ejected ink volume, Vink.

The reduction rate R changes with respect to Vink as indicated in FIG. 9. More specifically, as shown in the diagram, in a low-density region, R has a value close to 1 (a large value), in a medium-density region, R has a small value, and in a high-density region, R has an intermediate value. The value of R is determined in this way for the reasons described below.

Figure 10A:
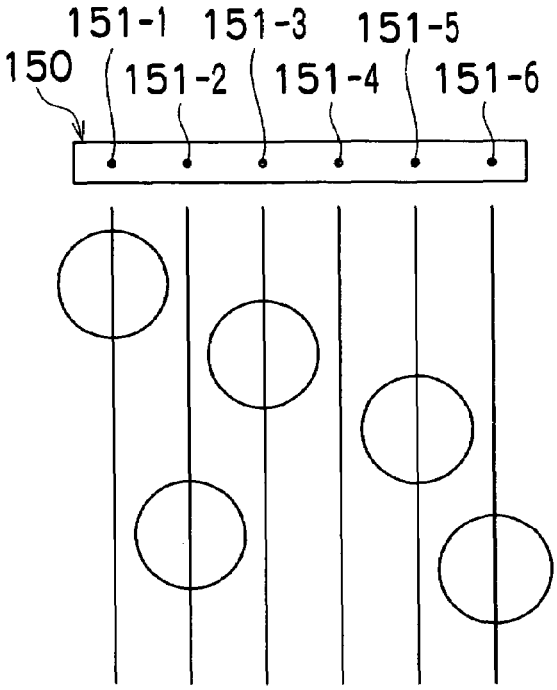
FIGS. 10A and 10B are schematic drawings showing examples of ink dot arrangements in a low-density region.
Figure 10B:
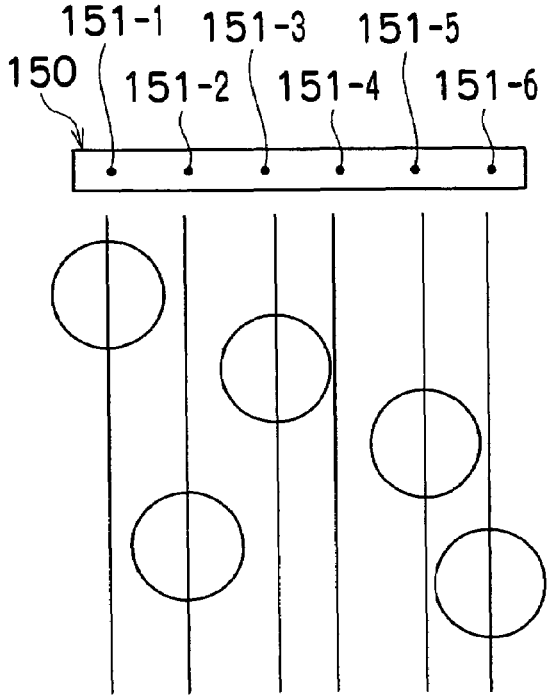
Figure 11A:
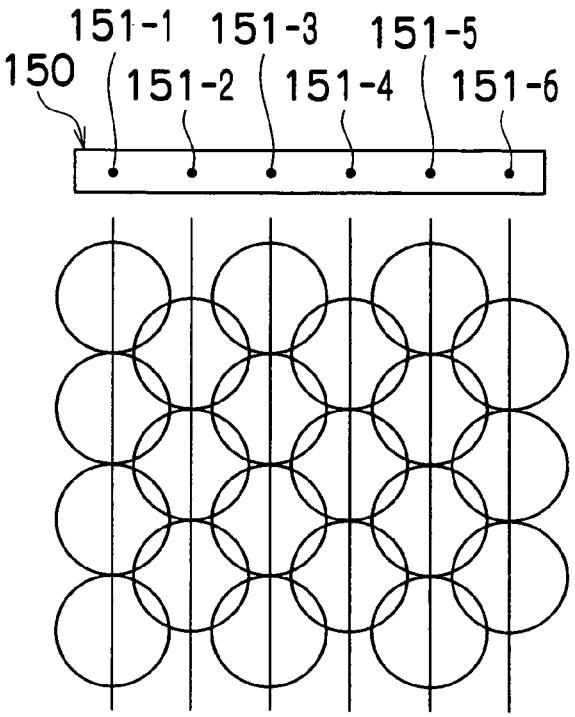
FIGS. 11A and 11B are schematic drawings showing examples of ink dot arrangements in a medium-density region.
Figure 11B:
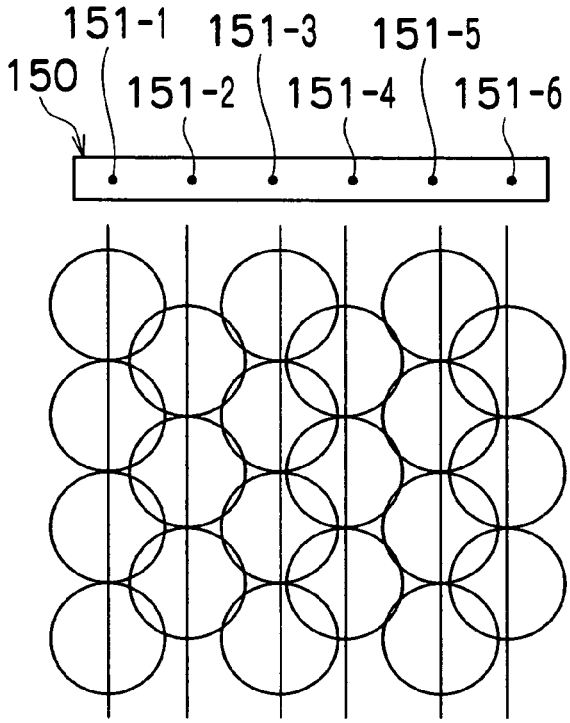
Figure 12A:
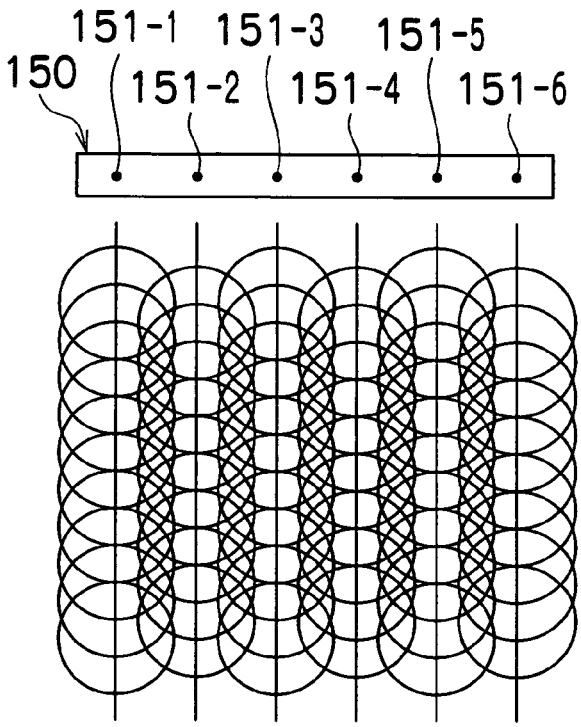
FIGS. 12A and 12B are schematic drawings showing examples of ink dot arrangements in a high-density region.
Figure 12B:
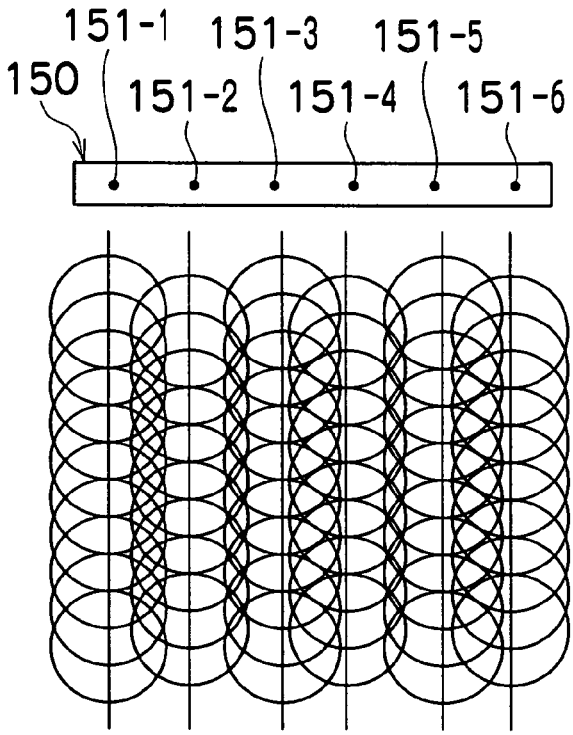

FIGS. 10A and 10B, 11A and 11B, and 12A and 12B show examples of the respective arrangements of ink dots for a low-density region, a medium-density region and a high-density region. Each of FIGS. 10A, 11A and 12A shows an example of a dot arrangement when the landing positions are normal, and each of FIGS. 10B, 11B and 12B shows an example of a dot arrangement when there is deviation in the landing positions. In these diagrams, reference numeral 150 indicates a line head, and reference numerals 151-*i* (i=1, 2, 3, 4, 5, 6) indicate nozzles. The dots formed by droplets ejected from the respective nozzles are indicated by circles. Furthermore, in the diagrams, the straight lines in the vertical direction (sub-scanning direction) are the center lines of the dot columns in the sub-scanning direction formed by droplets ejected from the nozzles 151-*i* (i=1, 2, 3, 4, 5, 6).

As shown in FIGS. 10A and 10B, in the low-density region, there is virtually no banding effect due to deviation in the landing positions. More specifically, in this density region, even if there is deviation in the landing positions, this will not be recognizable as banding. In this density region (low-density region), the granularity of the image, and the like, is considered to be more a serious problem than banding, and a decline in dot quality tends to cause a deterioration in the granularity of the image. Therefore, desirably, dot bleeding is suppressed by the use of treatment liquid.

By contrast, in a medium-density region, as shown in FIGS. 11A and 11B, notable banding occurs as a result of deviation in the landing positions. In this density region, due to the movement of the dot positions as a result of deviation in the landing positions, blank areas arise and the respective dots overlap to a greater extent than necessary. Consequently, in a medium-density region, the treatment liquid volume at the position where banding occurs is reduced, and the banding is made less conspicuous by allowing the dots to bleed.

Figure 13:
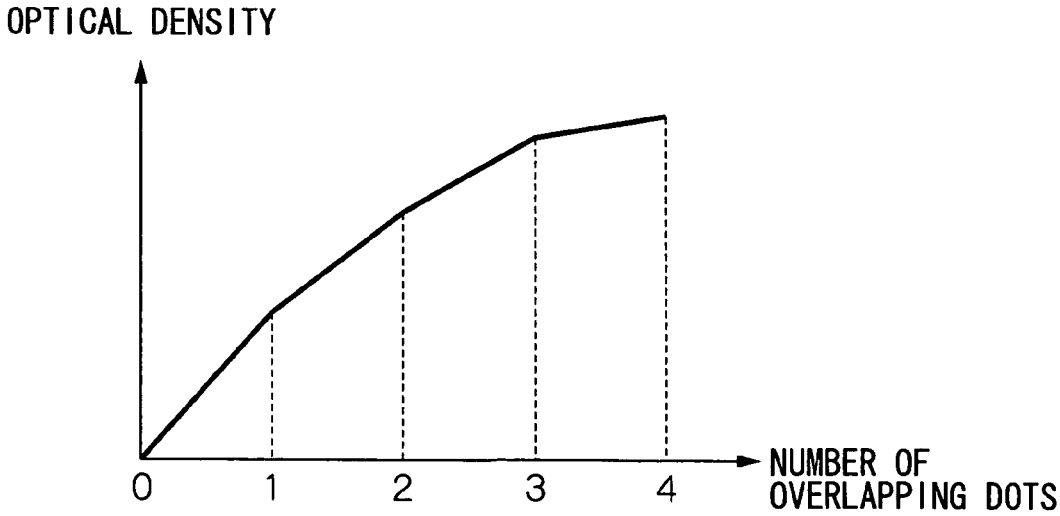
FIG. 13 is a graph showing the relationship between the number of overlapping dots and optical density.

Furthermore, in a high-density region, since the dots are densely overlapping, as shown in FIGS. 12A and 12B, then even if there is deviation in the landing positions, blank areas do not occur. Moreover, in general, the increase in density when the dots are mutually overlapping tends gradually to become saturated with respect to increase in the number of overlapping dots, as shown in FIG. 13, and consequently, the change in density due to deviation in the landing positions is not as notable as it is in the case of a medium-density region. Consequently, in this density region (high-density region), banding is not as conspicuous as it is in the case of a medium-density region. Furthermore, in a high-density region, it is necessary to leave the coloring material on the surface of the recording medium, thereby increasing the optical density. Consequently, the reduction rate R in the high-density region is set to a higher level than in the medium-density region.

Next, the general method of dividing a "low-density region", "medium-density region" and "high-density region" (namely, the method of classifying the density regions) will be described.

Taking the surface area of one dot achieved when bleeding is suppressed to be S ($\mu m^2$), the potential droplet ejection density in the main scanning direction, to be dm (dots per inch), the potential droplet ejection density in the sub-scanning direction to be ds (dots per inch), and the droplet ejection rate (the ratio of the dots actually ejected to the potential droplet ejection density), to be p (where $0 \leqq p \leqq 1$), then the "low-density region", "medium-density region" and "high-density region" are respectively defined by the following conditional formulas:

$$\text{Low-density region: } 0 \leqq S \times dm \times ds \times p/(25400)^2 \leqq 1; \quad (2)$$

$$\text{Medium-density region: } 1 \leqq S \times dm \times ds \times p/(25400)^2 \leqq 2; \quad \text{and (3)}$$

$$\text{High-density region: } 2 \leqq S \times dm \times ds \times p/(25400)^2. \quad (4)$$

Conditions which are equal to different formulas (conditions at the boundary between different density regions) may be included in either of the regions. In the formulas given above, S×dm×ds×p is the total surface area of the dots formed by ejected droplets per square inch ($=25400^2$ ($\mu m^2$)). Therefore, $S \times dm \times ds \times p = 25400^2$ indicates a case where the dots are generally not overlapping and where is no blank surface, over the whole of the region. In other words, Formula (2) indicates a state where the dots are not overlapping, Formula (3) indicates a state where the dots are overlapping in some places and not overlapping in other places, and Formula (4) indicates a state where all of the dots are overlapping. If a mixture of dots of two or more different sizes are ejected, then the value of S(i)×dm×ds×p(i) is determined for each size i of dot, and the sum of these value is taken as the value of S×dm×ds×p.

Figure 14:
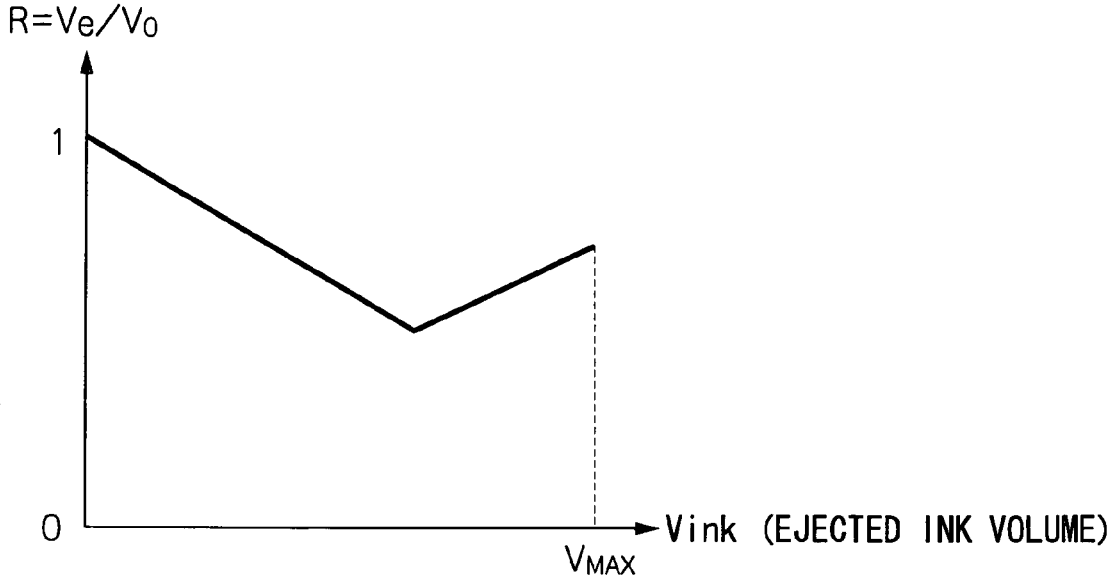
FIG. 14 is a graph showing an example where the reduction rate R of the treatment liquid is changed continuously with respect to the ejected ink volume Vink.
Figure 15:
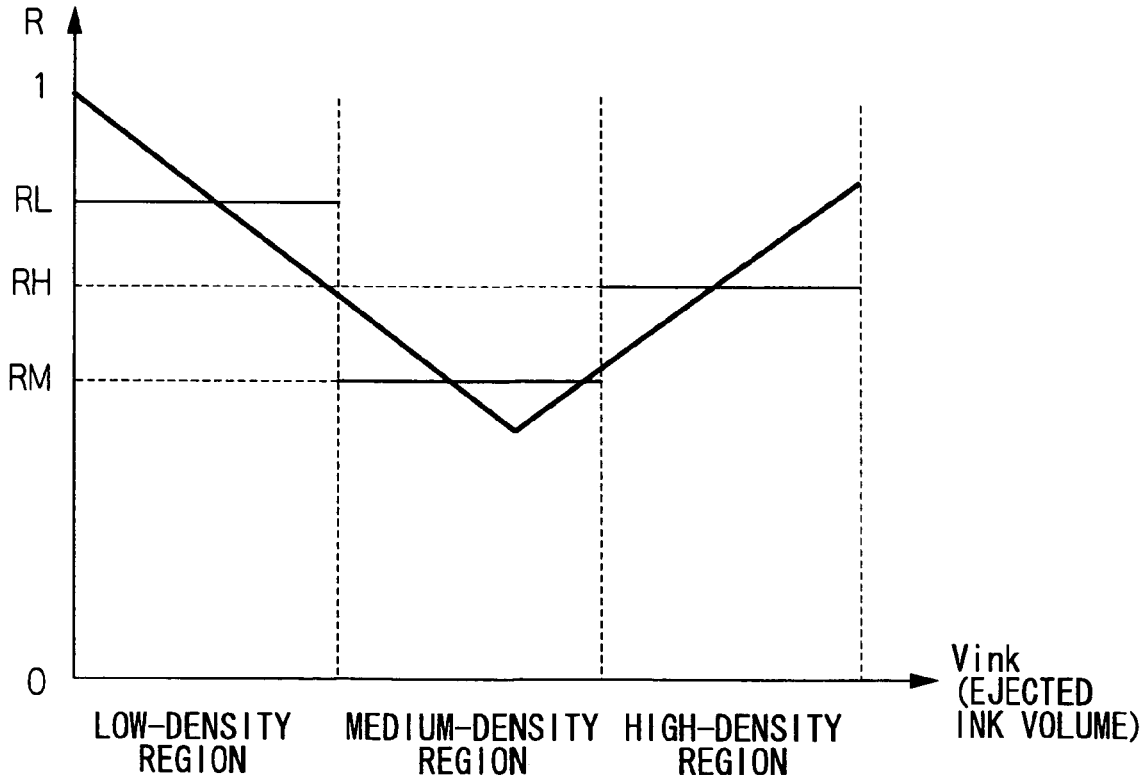
FIG. 15 is a graph for describing the relationship between the average values of the reduction rate R of the treatment liquid in respective regions, a low-density region, medium-density region and high-density region.

In the present embodiment, as shown in FIG. 9, the droplet ejection volume is divided into three regions, namely, the low-density region, the medium-density region, and the high-density region, but the method of dividing the droplet ejection volume is not limited to this. For example, as shown in FIG. 14, the value of R may also be changed in a continuous fashion with respect to the value of Vink. Furthermore, in a mode where R is changed continuously with respect to Vink, desirably, the average values of R in the respective density regions, the low-density region, medium-density region and high-density region, namely, RL, RM and RH, satisfy the relationship RM<RH<RL, as shown in FIG. 15. The embodiment in FIG. 9 clearly satisfies this relationship. Furthermore, this embodiment is only described with respect to deviation in the landing positions of the dots, but correction can be performed by using a similar approach with respect to deviation in the ejection volume, also.

As a method for reducing the treatment liquid droplet ejection volume Ve(Vink) at a position where banding occurs, it is possible to (1) reduce the volume per droplet of treatment liquid, or (2) thin out the dots of treatment liquid, while using the same volume per droplet of treatment liquid as the other parts of the image; or to use a combination of these methods, or the like. The method of changing the value of R may be varied according to the type of ink and recording medium used.

Figure 16:
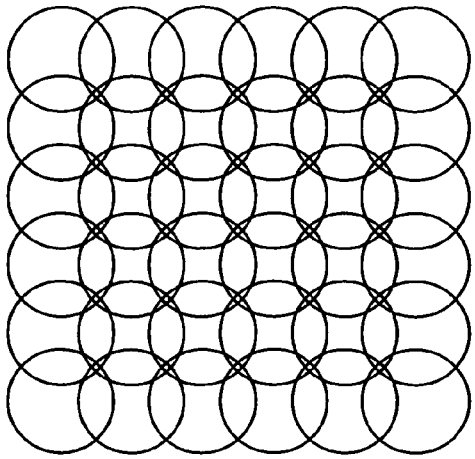
FIG. 16 is a schematic drawing showing an example of a treatment liquid dot arrangement.
Figure 17:
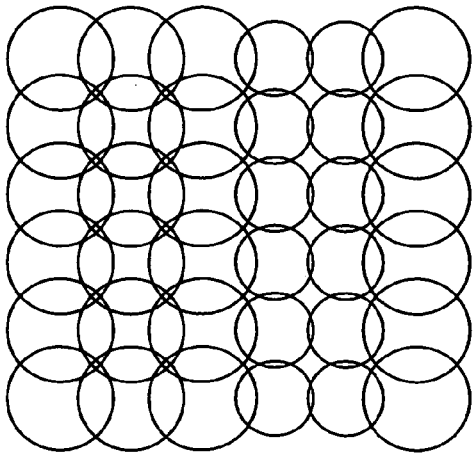
FIG. 17 is a schematic drawing showing an example of a treatment liquid dot arrangement.
Figure 18:
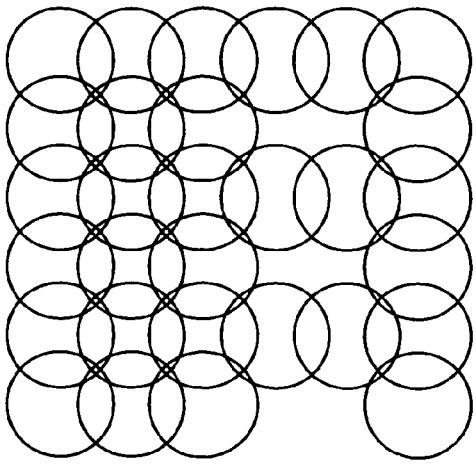
FIG. 18 is a schematic drawing showing an example of a treatment liquid dot arrangement.
Figure 19:
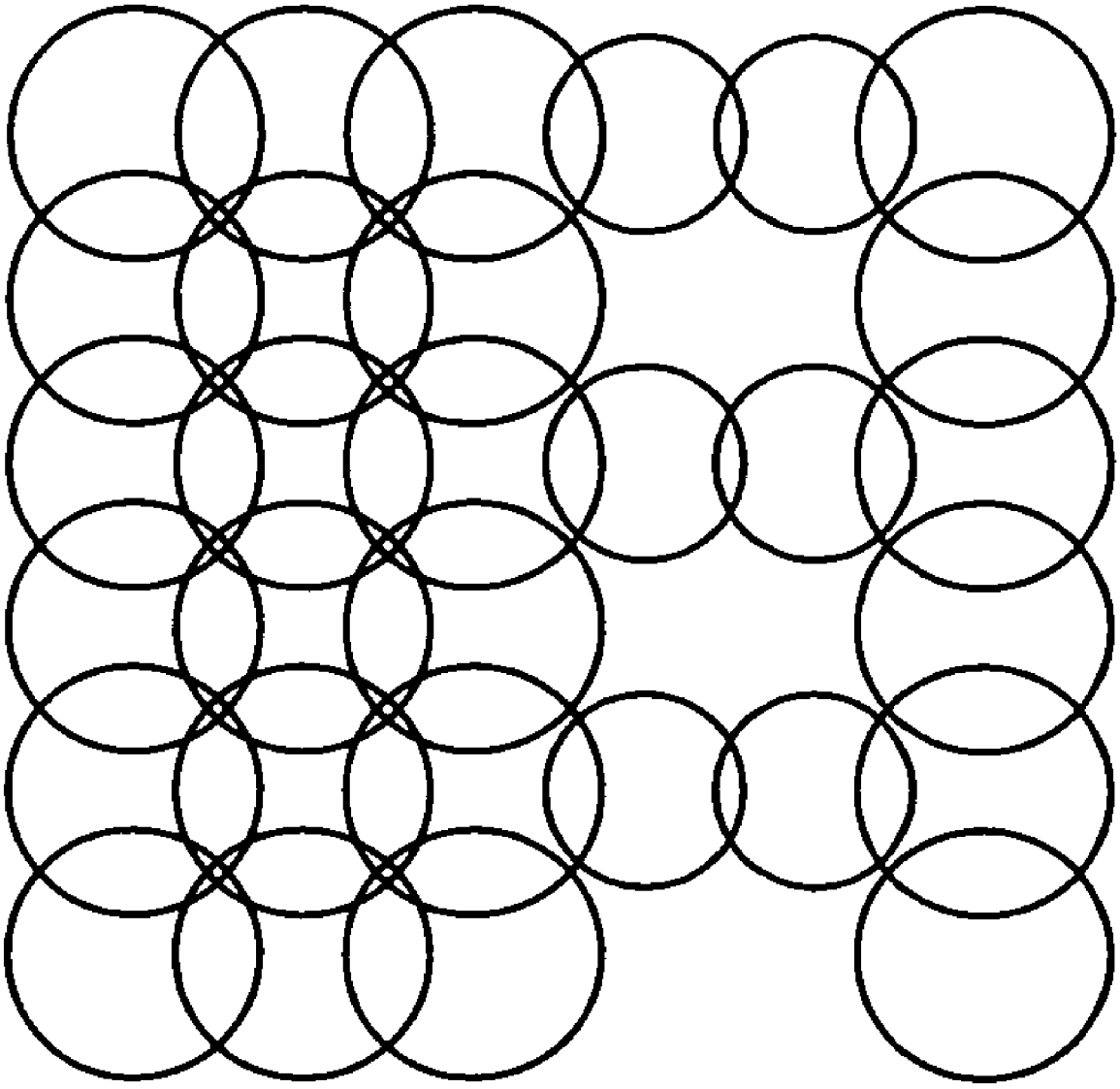
FIG. 19 is a schematic drawing showing an example of a treatment liquid dot arrangement.
Figure 20:
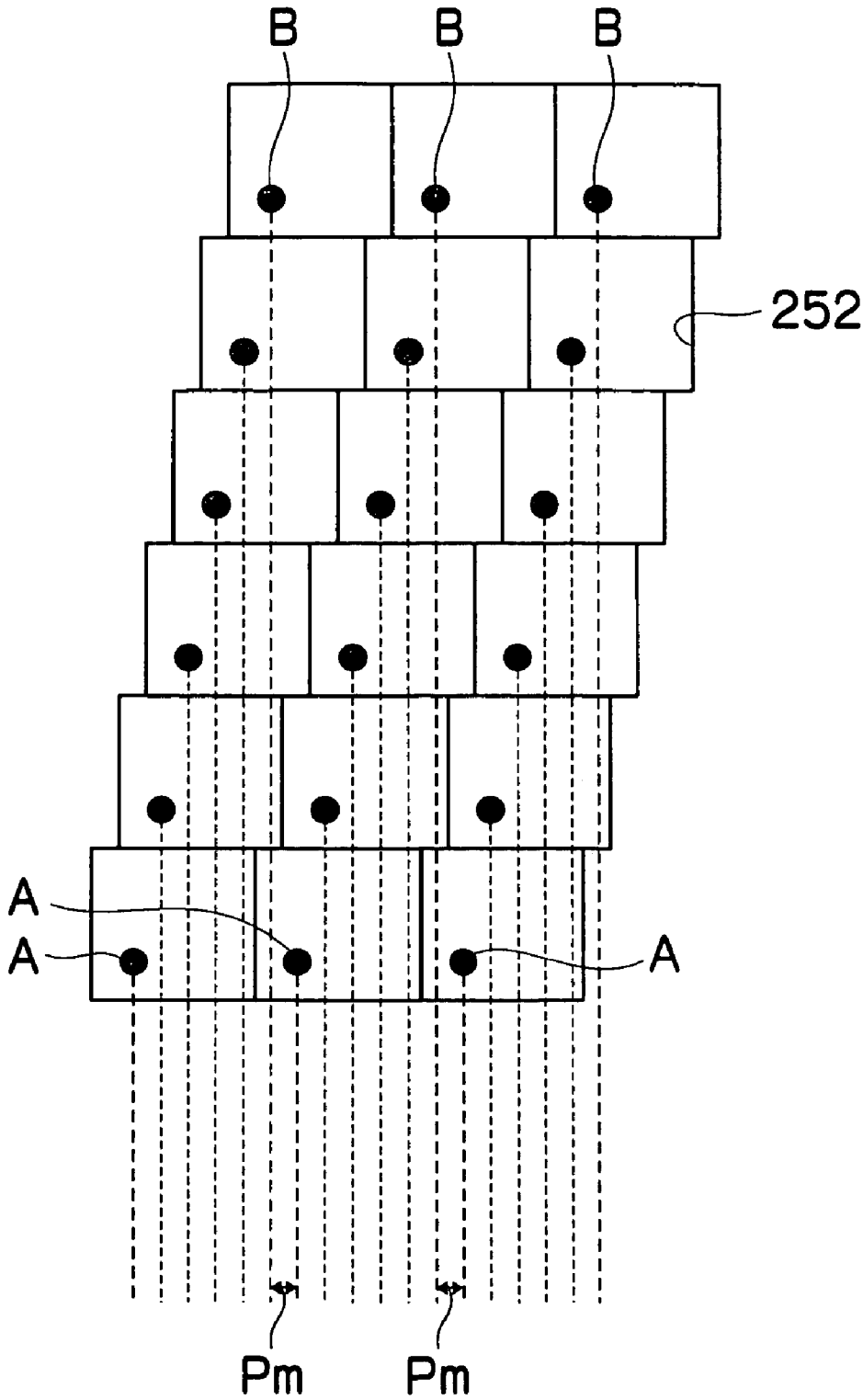
FIG. 20 is a schematic plan diagram of a head for describing banding occurring at the return sections in nozzle rows of a head having a two-dimensional nozzle arrangement.
Figure 21:
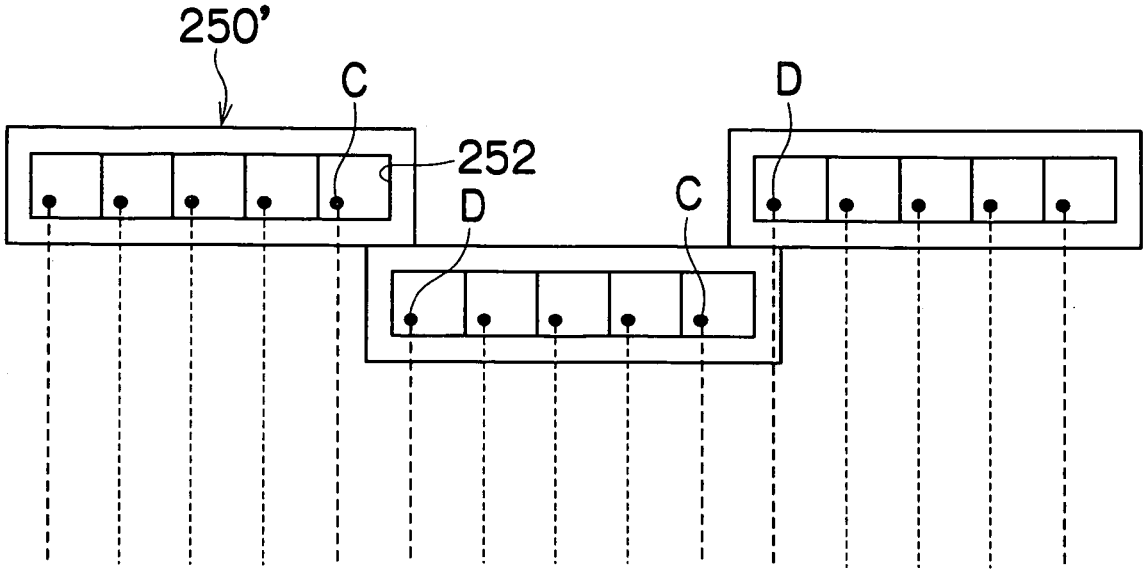
FIG. 21 is a schematic plan diagram of a head for describing banding occurring at the joint positions of short head modules.

FIGS. 16 to 19 show schematic views of examples of droplets deposited to form dots of treatment liquid. In these diagrams, the horizontal direction of the paper surface corresponds to the main scanning direction, and the vertical direction of the paper surface corresponds to the sub-scanning direction. FIG. 16 shows an example of a normal treatment liquid dot arrangement (a treatment liquid dot arrangement in a region other than one where banding occurs). FIG. 17 shows an example of a dot arrangement in a case where the volume per droplet of treatment liquid has been reduced in a region subject to banding. FIG. 18 shows an example of a dot arrangement in a case where the volume per droplet of treatment liquid is the same as in other places (normal regions), but the treatment liquid dots have been thinned out by increasing the ejection drive interval (period) for the treatment liquid. FIG. 19 shows an example of a dot arrangement in a case where the volume per droplet of treatment liquid has been reduced and the ejection drive interval for the treatment liquid has also been increased, in a region subject to banding.

Returning to the description of the flowchart in FIG. 8, as described above, when the reduction rate R(Vink) of the treatment liquid has been calculated for a banding region (step S118), dot data for the treatment liquid is created on the basis of that reduction rate R (step S120). Thereupon, in synchronism with the conveyance of the recording medium 16 (step S122), the treatment liquid ejection heads 13 are driven on the basis of the treatment liquid dot data, thereby depositing treatment liquid on the recording medium 16 (step S124), and the ink droplet ejection heads 50 are driven on the basis of the ink dot data, thereby depositing droplets of ink (step S126).

As described above, according to the present embodiments, by reducing the volume of treatment liquid in a region where banding occurs below the volume of treatment liquid in other locations, it is possible to reduce the visibility of banding by allowing the dots of coloring material to bleed in the region where banding occurs. Furthermore, since a composition is adopted whereby the amount of reduction of the recording liquid is controlled in accordance with the ink droplet ejection volume, on the basis of the input image, then the extent of bleeding allowed can be controlled in accordance with the ink droplet ejection volume, and hence an optimal image can be designed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet ejection head in which a plurality of ink ejection ports ejecting ink are arranged;

a treatment liquid ejection head in which a plurality of treatment liquid ejection ports ejecting treatment liquid are arranged;

a banding information acquisition device which acquires information identifying a location where banding occurs in a dot arrangement recorded into a recording medium by the ink ejected from the ink ejection head;

an ink droplet ejection control device which controls a volume of the ink ejected by the ink ejection head according to image data; and a treatment liquid droplet ejection control device which controls droplet ejection of the treatment liquid from the treatment liquid ejection head by controlling a rate of reduction R(Vink) of the treatment liquid at the location where the banding occurs, in accordance with the volume Vink of the ink determined according to the image data, where Ve(Vink) is the volume of the treatment liquid corresponding to Vink at the location where the banding occurs, V0(Vink) is the volume of the treatment liquid corresponding to Vink at at location where the banding does not occur, and R(Vink) =Ve(Vink)/V0(Vink).

2. The inkjet recording apparatus as defined in claim 1, wherein the treatment liquid droplet ejection control device reduces a volume per droplet of the treatment liquid ejected from the treatment liquid ejection ports corresponding to the location where the banding occurs, in comparison with a volume per droplet of the treatment liquid ejected from the treatment liquid ejection pods corresponding to the regions other than the location where the banding occurs.

3. The inkjet recording apparatus as defined in claim 1, wherein the rates of reduction of the treatment liquid determined for a low-density region, a medium-density region and a high-density region of the printed image have the following relationship:

the rate of reduction for the low-density region is greater than the rate of reduction for the high-density region which is greater than the rate of reduction for the medium-density region.

4. An inkjet recording apparatus, comprising:

an inkjet ejection head in which a plurality of ink ejection ports ejecting ink are arranged;

a treatment liquid ejection head in which a plurality of treatment liquid ejection ports ejecting treatment liquid are arranged;

a banding information acquisition device which acquires information identifying a location where banding occurs in a dot arrangement recorded into a recording medium by the ink ejected from the ink ejection head;

an ink droplet ejection control device which controls a volume of the ink ejected by the ink ejection head according to image data; and a treatment liquid droplet ejection control device which controls droplet ejection of the treatment liquid from the treatment liquid ejection head by controlling a volume of the treatment liquid ejected from the treatment liquid ejection ports corresponding to the location where the banding occurs, as identified by the banding information acquisition device, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs, wherein a rate of reduction R(Vink) of the treatment liquid at the location where the banding occurs satisfies a relationship of R(Vink)=Ve(Vink)/V0(Vink), where Vink is the volume of the ink determined according to the image data, Ve(Vink) is the volume of the treatment liquid corresponding to Vink at the location where the banding occurs, and V0(Vink) is the volume of the treatment liquid corresponding to Vink at a location where the banding does not occur, then the rates of reduction of the treatment liquid determined for a low-density region and a medium-density region of the printed image have the following relationship:

the rate of reduction for the low-density region is greater than the rate of reduction for the medium-density region.

5. An inkjet recording apparatus, comprising:

an inkjet ejection head in which a plurality of ink ejection ports ejecting ink are arranged;

a treatment liquid ejection head in which a plurality of treatment liquid ejection ports ejecting treatment liquid are arranged;

a banding information acquisition device which acquires information identifying a location where banding occurs in a dot arrangement recorded into a recording medium by the ink ejected from the ink ejection head;

an ink droplet ejection control device which controls a volume of the ink ejected by the ink election head according to image data; and a treatment liquid droplet ejection control device which controls droplet ejection of the treatment liquid from the treatment liquid ejection head by controlling a volume of the treatment liquid ejected from the treatment liquid ejection ports corresponding to the location where the banding occurs, as identified by the banding information acquisition device, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs, wherein a rate of reduction R(Vink) of the treatment liquid at the location where the banding occurs satisfies a relationship of R(Vink)=Ve(Vink)/V0(Vink), where Vink is the volume of the ink determined according to the image data, Ve(ink) is the volume of the treatment liquid corresponding to Vink at the location where the banding occurs, and V0(Vink) is the volume of the treatment liquid corresponding to Vink at a location where the banding does not occur, then the rates of reduction of the treatment liquid determined for a medium-density region and a high-density region of the printed image have the following relationship:

the rate of reduction for the high-density region is greater than the rate of reduction for the medium-density region.

6. An inkjet recording apparatus, comprising:

an inkjet ejection head in which a plurality of ink ejection ports ejecting ink are arranged;

a treatment liquid ejection head in which a plurality of treatment liquid ejection ports ejecting treatment liquid are arranged;

a banding information acquisition device which acquires information identifying a location where banding occurs in a dot arrangement recorded into a recording medium by the ink ejected from the ink ejection head;

an ink droplet ejection control device which controls a volume of the ink ejected by the ink ejection head according to image data; and a treatment liquid droplet ejection control device which controls droplet ejection of the treatment liquid from the treatment liquid ejection head by controlling a volume of the treatment liquid ejected from the treatment liquid ejection ports corresponding to the location where the banding occurs, as identified by the banding information acquisition device, in accordance with the volume of the ink in such a manner that the treatment liquid ejection ports corresponding to the location where the banding occurs eject the treatment liquid of a smaller volume than the volume of the treatment liquid ejected from the treatment liquid ejection ports corresponding to regions other than the location where the banding occurs.

wherein the treatment liquid droplet ejection control device increases an ejection drive interval from the treatment liquid ejection ports corresponding to the location where the banding occurs, in comparison with an ejection drive interval from the treatment liquid election ports corresponding to the regions other than the location where the banding occurs.

7. An inkjet recording method of forming an image on a recording medium by using ink and treatment liquid; the method comprising the steps of:

acquiring banding information identifying a location where banding occurs in a dot arrangement recorded onto a recording medium by ink ejected from an ink ejection head having a plurality of ink ejection ports;

performing ink droplet ejection control to control a volume of the ink ejected by the ink ejection head according to image data; and performing treatment liquid droplet ejection control to control droplet ejection of treatment liquid from a treatment liquid ejection head by controlling a rate of reduction R(Vink) of the treatment liquid at the location where the banding occurs, in accordance with the volume Vink of the ink determined according to the image data, where Ve(Vink) is the volume of the treatment liquid corresponding to Vink at the location where the banding occurs, V0(Vink) is the volume of the treatment liquid corresponding to Vink at a location where the banding does not occur, and R(Vink)-Ve(Vink)/V0(Vink).

* * * * *